US012163521B2

(12) United States Patent
Dong et al.

(10) Patent No.: US 12,163,521 B2
(45) Date of Patent: Dec. 10, 2024

(54) COMPRESSOR, AIR CONDITIONER AND METHOD FOR ASSEMBLING COMPRESSOR

(71) Applicant: Green Refrigeration Equipment Engineering Research Center of Zhuhai Gree Co., Ltd., Guangdong (CN)

(72) Inventors: Mingzhu Dong, Guangdong (CN); Hui Huang, Guangdong (CN); Yusheng Hu, Guangdong (CN); Huijun Wei, Guangdong (CN); Yanjun Hu, Guangdong (CN); Ouxiang Yang, Guangdong (CN); Peizhen Que, Guangdong (CN); Yuanbin Zhai, Guangdong (CN); Liu Xiang, Guangdong (CN)

(73) Assignee: GREEN REFRIGERATION EQUIPMENT ENGINEERING RESEARCH CENTER OF ZHUHAI GREE CO., LTD., Guangdong (CN)

( * ) Notice: Subject to any disclaimer, the term of this patent is extended or adjusted under 35 U.S.C. 154(b) by 494 days.

(21) Appl. No.: 16/627,259

(22) PCT Filed: Dec. 25, 2017

(86) PCT No.: PCT/CN2017/118327
§ 371 (c)(1),
(2) Date: Dec. 27, 2019

(87) PCT Pub. No.: WO2019/029094
PCT Pub. Date: Feb. 14, 2019

(65) Prior Publication Data

US 2020/0217317 A1 Jul. 9, 2020

(30) Foreign Application Priority Data

Aug. 10, 2017 (CN) ..... 201710684426.7

(51) Int. Cl.
*F04C 18/356* (2006.01)
*F04C 23/00* (2006.01)
*F04C 28/06* (2006.01)

(52) U.S. Cl.
CPC ..... *F04C 28/065* (2013.01); *F04C 23/001* (2013.01); *F04C 18/356* (2013.01); *F04C 18/3564* (2013.01); *F04C 2240/30* (2013.01)

(58) Field of Classification Search
CPC ..... F04C 23/001–003; F04C 23/008; F04C 18/356; F04C 18/3564; F04C 2240/30
See application file for complete search history.

(56) References Cited

U.S. PATENT DOCUMENTS

2011/0176949 A1 7/2011 Byun
2015/0078928 A1* 3/2015 Wei ..... F04C 28/02 417/245

FOREIGN PATENT DOCUMENTS

CN 1576598 A 2/2005
CN 1796790 A 7/2006
(Continued)

OTHER PUBLICATIONS

Office Action for Japanese Patent Application No. 2019-571581 dated Jan. 6, 2021 (6 pages).
(Continued)

*Primary Examiner* — Thomas Fink
(74) *Attorney, Agent, or Firm* — J. Miguel Hernandez; James R. Gourley; Carstens, Allen & Gourley, LLP

(57) ABSTRACT

Disclosed are a compressor, an air conditioner and a method for assembling a compressor, wherein the compressor includes a housing, a first cylinder assembly and a second cylinder assembly. The first cylinder assembly includes a first cylinder. The first cylinder assembly has a first discharge channel. A first end of the first discharge channel is in communication with the first cylinder, a second end of the
(Continued)

first discharge channel is in communication with a receiving chamber. The second cylinder assembly includes a second cylinder; the second cylinder is disposed adjacent to the first cylinder. The second cylinder assembly has a second discharge channel which is disposed relatively independent of the first discharge channel. A first end of the second discharge channel is connected to the second cylinder; a second end of the second discharge channel is in communication with a receiving chamber.

12 Claims, 19 Drawing Sheets

(56) References Cited

FOREIGN PATENT DOCUMENTS

| | | | | | |
|---|---|---|---|---|---|
| CN | 202266430 | U | * | 6/2012 | |
| CN | 103410734 | A | * | 11/2013 | |
| CN | 103827500 | A | * | 5/2014 | ..... F04C 18/356 |
| CN | 203962391 | U | | 11/2014 | |
| CN | 104251207 | A | | 12/2014 | |
| CN | 105485013 | A | | 4/2016 | |
| CN | 105485021 | A | * | 4/2016 | ..... F04C 29/12 |
| CN | 105673488 | A | * | 6/2016 | |
| CN | 205277818 | U | * | 6/2016 | |
| CN | 105782042 | A | * | 7/2016 | |
| CN | 106567831 | A | | 4/2017 | |
| CN | 107476979 | A | | 12/2017 | |
| JP | 2008133820 | A | | 6/2008 | |
| JP | 4806552 | B2 | | 11/2011 | |
| WO | WO-2016114016 | A1 | * | 7/2016 | ..... F01C 21/0881 |
| WO | 2017/101537 | A1 | | 6/2017 | |

OTHER PUBLICATIONS

English translation of CN 203962391U published on Nov. 26, 2014 (10 pages).
English translation of WO 2017/101537 A1 published on Jun. 22, 2017 (8 pages).
Extended European Search Report for EP 17920795.6 dated Jul. 6, 2020 (10 pages).

* cited by examiner

COMPRESSOR, AIR CONDITIONER AND METHOD FOR ASSEMBLING COMPRESSOR

TECHNICAL FIELD

The present disclosure relates to the field of air conditioner technology, and particularly to a compressor, an air conditioner and a method for assembling a compressor.

BACKGROUND

In the prior art, a household multi-couple air-conditioning system consisting of one outdoor unit and multiple indoor units, can separately adjust the temperatures of the multiple indoor units. Thus, the household multi-couple air-conditioning system has the advantages of separate control, energy saving and comfort. In practical application, the total indoor cooling demand only accounts for 20% to 40% of the rated output of the system in most time periods. Especially when a single indoor unit is turned on, the minimum cooling capacity output of the air conditioning system is greater than the indoor cooling demand, so that the compressor runs at a low frequency for a long time; or continuous switching between the shutdown state and the power-on state, makes the compressor of the air-conditioning system run at a low-frequency, which causes the problem of low energy efficiency of the air-conditioning system. The compressor in the prior art is apt to cause frequent shutdown and startup of the compressor, in addition to causing great indoor temperature fluctuations and reducing the user experience, further causing a problem of increasing the energy consumption of the compressor.

SUMMARY

The main objective of the present disclosure is to provide a compressor, an air conditioner and a method for assembling a compressor, to solve the technical problem of frequent shutdown and startup of the compressor in the prior art.

In order to implement the above purposes, according to one aspect of the disclosure, a compressor is provided, and the compressor includes: a housing having a receiving chamber; a first cylinder assembly disposed inside the housing; the first cylinder assembly including a first cylinder; the first cylinder assembly having a first discharge channel; a first end of the first discharge channel being in communication with the first cylinder; and a second end of the first discharge channel being in communication with the receiving chamber; a second cylinder assembly, disposed inside the housing; the second cylinder assembly including a second cylinder, the second cylinder being disposed adjacent to the first cylinder, the second cylinder assembly having a second discharge channel, the second discharge channel being arranged relatively independent of the first discharge channel; a first end of the second discharge channel being connected to the second cylinder; a second end of the second discharge channel being in communication with the receiving chamber; wherein, when the first cylinder is in an operating state, the second cylinder is in an operating state or the second cylinder is in an idling state.

Furthermore, the second cylinder has a sliding vane slot and an intake channel, and the second cylinder assembly further includes: a slide vane disposed in the sliding vane slot, wherein a variable-volume control chamber is formed between an end of the sliding vane, which is adjacent to an outer peripheral surface of the second cylinder, and an inner wall of the sliding vane slot; a first end of the intake channel is in communication with the variable-volume control cavity, and a second end of the intake channel is configured to introduce high-pressure refrigerant or low-pressure refrigerant.

Furthermore, the second cylinder assembly further includes: a locking pin disposed adjacent to the second cylinder and located at a side of the sliding vane, wherein the locking pin has a locking place for locking the sliding vane and an unlocking place for releasing the sliding vane from the locking place; when the sliding vane is in the locking place, the second cylinder is in the idling state; and when the sliding vane is in the unlocking place, the second cylinder is in the operating state.

Furthermore, the second cylinder assembly further has a second suction channel, and the intake channel is arranged relatively independent of the second suction channel; when the high-pressure refrigerant is introduced into the intake passage, the locking pin is in the unlocking place; and when the low-pressure refrigerant is introduced into the intake passage, the locking pin is in the locking place.

Furthermore, the first cylinder is provided to be coaxial with the second cylinder, and the second cylinder assembly further includes: a diaphragm located between the first cylinder and the second cylinder.

Furthermore, the diaphragm is provided with a receiving cavity body for storing refrigerant compressed by the second cylinder.

Furthermore, the diaphragm includes: a first diaphragm, which is provided with a first annular groove; a second diaphragm located under the first diaphragm; wherein a surface of the second diaphragm facing the first diaphragm is provided with a second annular groove; the second diaphragm is disposed opposite to the first diaphragm; the first annular groove and the second annular groove form the receiving cavity body; the second diaphragm is provided with a first channel; a first end of the first channel is in communication with the receiving cavity body, a second end of the first channel is in communication with the second cylinder.

Furthermore, a discharge valve is provided in the first channel; the discharge valve has a closed position and an open position; the second cylinder is disconnected from the receiving cavity body when the discharge valve is located in a closed position; and the second cylinder is in communication with the receiving cavity body when the discharge valve is located in an open position.

Furthermore, the second discharge channel includes a second channel; the first diaphragm and/or the second diaphragm are provided with the second channel; an end of the second channel is in communication with the receiving cavity body; another end of the second channel is in communication with the receiving chamber; the refrigerant discharged from the second cylinder enters the receiving cavity body through the first channel, and then is discharged into the receiving chamber through the second channel.

Furthermore, the second discharge channel further includes a third passage, and the second cylinder assembly further includes: a lower flange connected to a lower end surface of the second cylinder, wherein the lower flange is provided with the third channel; a first end of the third channel is in communication with the second cylinder; a second end of the third channel is in communication with the receiving chamber; and the locking pin is disposed in the lower flange.

Furthermore, a flow area of the first channel is a same as a flow area of the third channel.

Furthermore, the first cylinder assembly further includes: an upper flange connected to an upper end surface of the first cylinder, wherein the first discharge channel is provided in the upper flange; the first end of the first discharge channel is in communication with the first cylinder; the second end of the first discharge channel is in communication with the receiving chamber; a sum of a minimum flow area of the first channel and a minimum flow area of the third channel is greater than or equal to a minimum flow area of the first discharge channel.

Furthermore, a volume ratio of a volume of the first cylinder to a volume of the second cylinder is Q, wherein $0.3<Q<1$, or $0.3<Q\leq 0.7$, or $0.5\leq Q\leq 0.7$.

Furthermore, the first cylinder has a first suction channel; the second cylinder has a second suction passage; a volume ratio of a volume of the first cylinder to a volume of the second cylinder is Q, wherein, when $0.3<Q\leq 0.7$; a minimum flow area of the second suction channel is greater than a minimum flow area of the first suction channel; and a sum of a minimum flow area of the second discharge channel and the minimum flow area of the third channel is greater than the minimum flow area of the first discharge channel.

Furthermore, a volume ratio of a volume of the first cylinder to the volume of the second cylinder is Q; when $0.3<Q<0.7$, then $R1<R2$ and $H1<H2$, wherein R1 is an inner diameter of the first cylinder; H1 is a height of the first cylinder; R2 is an inner diameter of the second cylinder, and H2 is a height of the second cylinder; and when $0.7\leq Q<1$, then $R1=R2$ and $H1<H2$.

Furthermore, the compressor further includes: a first roller disposed in the first cylinder; a second roller disposed in the second cylinder; and a rotating shaft, wherein the rotating shaft sequentially passes through the first cylinder, the diaphragm and the second cylinder, and is connected to the first roller and the second roller; an inner diameter of the first roller is r1; an inner diameter of the second roller is R2; an inner diameter of the diaphragm is r3; a volume ratio of a volume of the first cylinder to a volume of the second cylinder is Q; wherein when $0.3<Q<0.7$, then $r1<r3<r2$; when $0.7\leq Q<1$, then $r1=r2<r3$.

Furthermore, a plurality of the first cylinder assemblies are provided, and/or a plurality of the second cylinder assemblies are provided.

According to another aspect of the disclosure, an air conditioner is provided, and the air conditioner includes the compressor above.

Furthermore, when the first cylinder and the second cylinder simultaneously operate, then $10\ HZ<f1<120\ HZ$, wherein f1 is an operating frequency of the compressor is f1; when the second cylinder is in an idling state, then $10\ HZ<f2<70\ HZ$, wherein f2 is the operating frequency of the compressor.

According to another aspect of the disclosure, a method for assembling a compressor is provided, and the method includes steps: mounting an upper flange on a first cylinder with a first centering screw; sequentially mounting a lower flange, a lower cover on a second cylinder with a second centering screw; a combining screw sequentially passing through the upper flange, the first cylinder and a diaphragm and being screwed on the second cylinder.

Further more, a number of the first centering screws is N1, wherein $2\leq N1\leq 3$; and/or a number of the second centering screws is N2, wherein $4\leq N2\leq 8$.

Through applying the technical solution of the present disclosure, the second cylinder is arranged to have an operating state, in which the second cylinder and the first cylinder operate simultaneously, and the second cylinder is configured to have an idling state. Thus the air-conditioning system having the compressor can adjust the second cylinder to be in the operating state or in the idling state according to the required indoor cooling capacity, and can make the first cylinder remain in the operating state all the time, thereby making the compressor remain in the operating state without shutdown, avoiding the problem in the prior art that all cylinders in the compressor are shut down when the required indoor cooling capacity reaches a preset value, and improving the practicability and reliability of the compressor.

BRIEF DESCRIPTION OF DRAWINGS

The accompanying drawings attached to the specification form a part of the application and are intended to provide a further understanding of the present disclosure. The illustrative embodiments of the disclosure and the description thereof are used for explanations of the present disclosure, and do not constitute improper limitations of the present disclosure. In the accompanying drawings.

Figure 1:
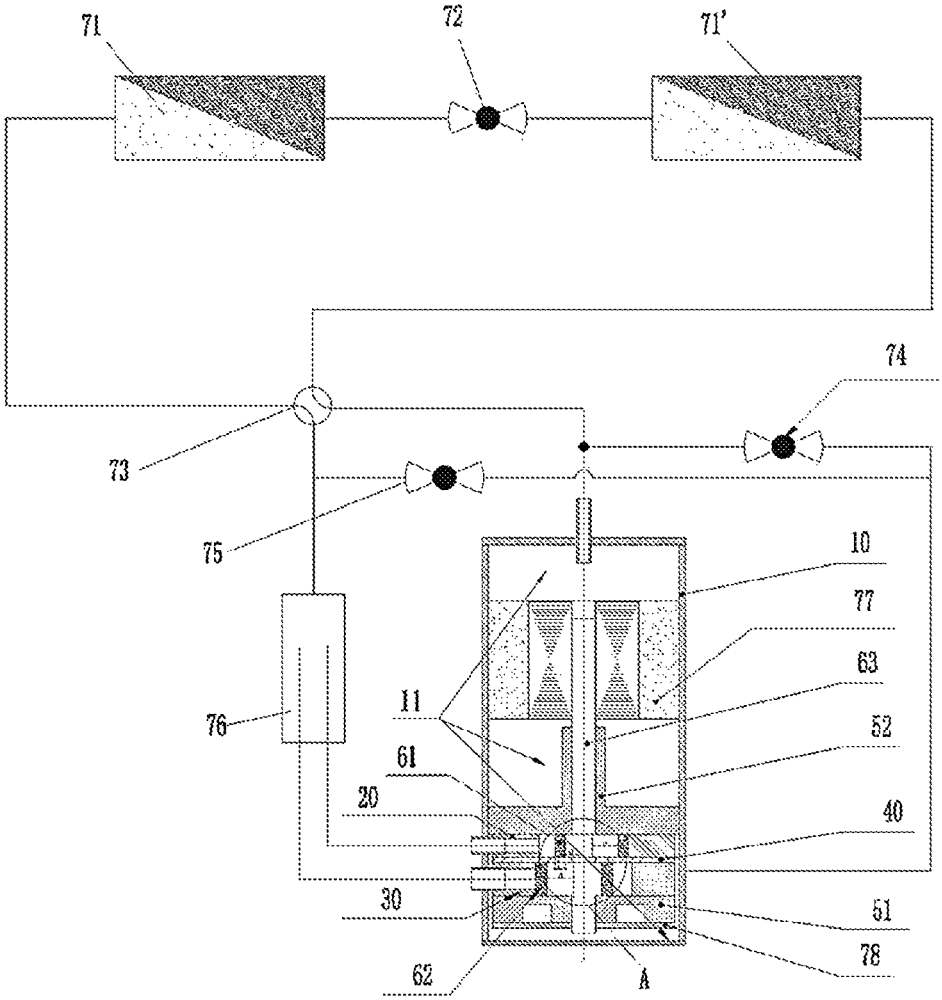
FIG. 1 is a schematic structure diagram of an air conditioner according to an embodiment of the present disclosure.

The above drawings include the following reference signs:

10, housing;

20, first cylinder; 21, sliding vane slot; 22, first suction channel; 23, spring; 24, sliding vane;

30, second cylinder; 31, sliding vane slot; 32, intake channel; 33, locking pin; 34, sliding vane; 341, sliding vane locking slot; 35, second suction channel;

40, diaphragm; 41, first diaphragm; 42, second diaphragm;

51, lower flange; 52, upper flange;

61, first roller; 62, second roller; 63, rotating shaft; 64, centering screw;

71, heat exchanger; 71', heat exchanger; 72, throttle valve; 73, four-way valve; 74, high-pressure valve; 75, low-pressure valve; 76, liquid separator; 77, motor; 78, lower cover plate; 79, return spring.

DETAILED DESCRIPTION OF DISCLOSED EMBODIMENTS

It should be noted that the embodiments in the present disclosure and the features in the embodiments can be combined with each other if no conflicts occur. The disclosure will be described in detail below with reference to the accompanying drawings in combination with the embodiments.

It should be noted that terms used herein are only for the purpose of describing specific embodiments and not intended to limit the exemplary embodiments of the disclosure. The singular of a term used herein is intended to include the plural of the term unless the context otherwise specifies. In addition, it should also be appreciated that when terms "include" and/or "comprise" are used in the description, they indicate the presence of features, steps, operations, devices, components and/or their combination.

It should be noted that the terms "first", "second", and the like in the description, claims and drawings of the present disclosure are used to distinguish similar objects, and are not necessarily used to describe a specific order or order. It should be appreciated that such terms can be interchangeable if appropriate, so that the embodiments of the disclosure described herein can be implemented, for example, in an order other than those illustrated or described herein. In addition, the terms "comprise", "have" and any deformations thereof, are intended to cover a non-exclusive inclusion, for example, a process, a method, a system, a product, or a device that includes a series of steps or units is not necessarily limited to explicitly list those steps or units, but can include other steps or units that are not explicitly listed or inherent to such a process, a method, a product or a device.

For convenience of description, spatially relative terms such as "above", "over", "on a surface of", "upper", etc., may be used herein to describe the spatial position relationships between one device or feature and other devices or features as shown in the drawings. It should be appreciated that the spatially relative term is intended to include different directions during using or operating the device other than the directions described in the drawings. For example, if the device in the drawings is inverted, the device is described as the device "above other devices or structures" or "on other devices or structures" will be positioned "below other devices or structures" or "under other devices or structures". Thus, the exemplary term "above" can include both "above" and "under". The device can also be positioned in other different ways (rotating 90 degrees or at other orientations), and the corresponding description of the space used herein is interpreted accordingly.

Now, the exemplary embodiments of the disclosure will be further described in detail with reference to the accompanying drawings. However, these exemplary embodiments can be implemented in many different forms and should not be construed as only limitation of the embodiments described herein. It should be appreciated that the embodiments are provided to make the present application disclosed thoroughly and completely, and to fully convey the concepts of the exemplary embodiments to those skilled in the art. In the accompanying drawings, for the sake of clarity, the thicknesses of layers and regions may be enlarged, and a same reference sign is used to indicate a same device, thus the description thereof will be omitted.

Referring to FIG. 1 through FIG. 20, according to an embodiment of the present disclosure, a compressor is provided.

Specifically, as shown in FIG. 1, the compressor includes a housing 10, a first cylinder assembly and a second cylinder assembly. The housing 10 has a receiving chamber. The first cylinder assembly is disposed inside the housing 10. The first cylinder assembly includes a first cylinder 20. The first cylinder assembly has a first discharge channel. A first end of the first discharge channel is in communication with the first cylinder 20, and a second end of the first discharge channel is in communication with the receiving chamber. The second cylinder assembly is disposed inside the housing 10. The second cylinder assembly includes a second cylinder 30. The second cylinder 30 is disposed adjacent to the first cylinder 20. The second cylinder assembly has a second discharge channel. The second discharge channel is arranged relatively independent of the first discharge channel. The first end of the second discharge channel is connected to the second cylinders 30, and the second end of the second discharge channel is in communication with the receiving chamber. When the first cylinder 20 is in an operating state, the second cylinder 30 is in an operating state, or the second cylinder 30 is in an idling state.

In the technical solution of the present embodiment, the second cylinder 30 is arranged to have an operating state, in which the second cylinder 30 operates simultaneously with the first cylinder 20, and the second cylinder 30 is configured to have an idling state when idling. Thus the air-conditioning system having the compressor can adjust the second cylinder 30 to be in the operating state or in the idling state according to the required indoor cooling capacity, and make the first cylinder 20 remain in the operating state, thereby making the compressor remain in the operating state without shutdown, avoiding the problem in the prior art that all cylinders in the compressor are shut down when the required indoor cooling capacity reaches a preset value, and improving practicability and the reliability of the compressor.

Figure 6:
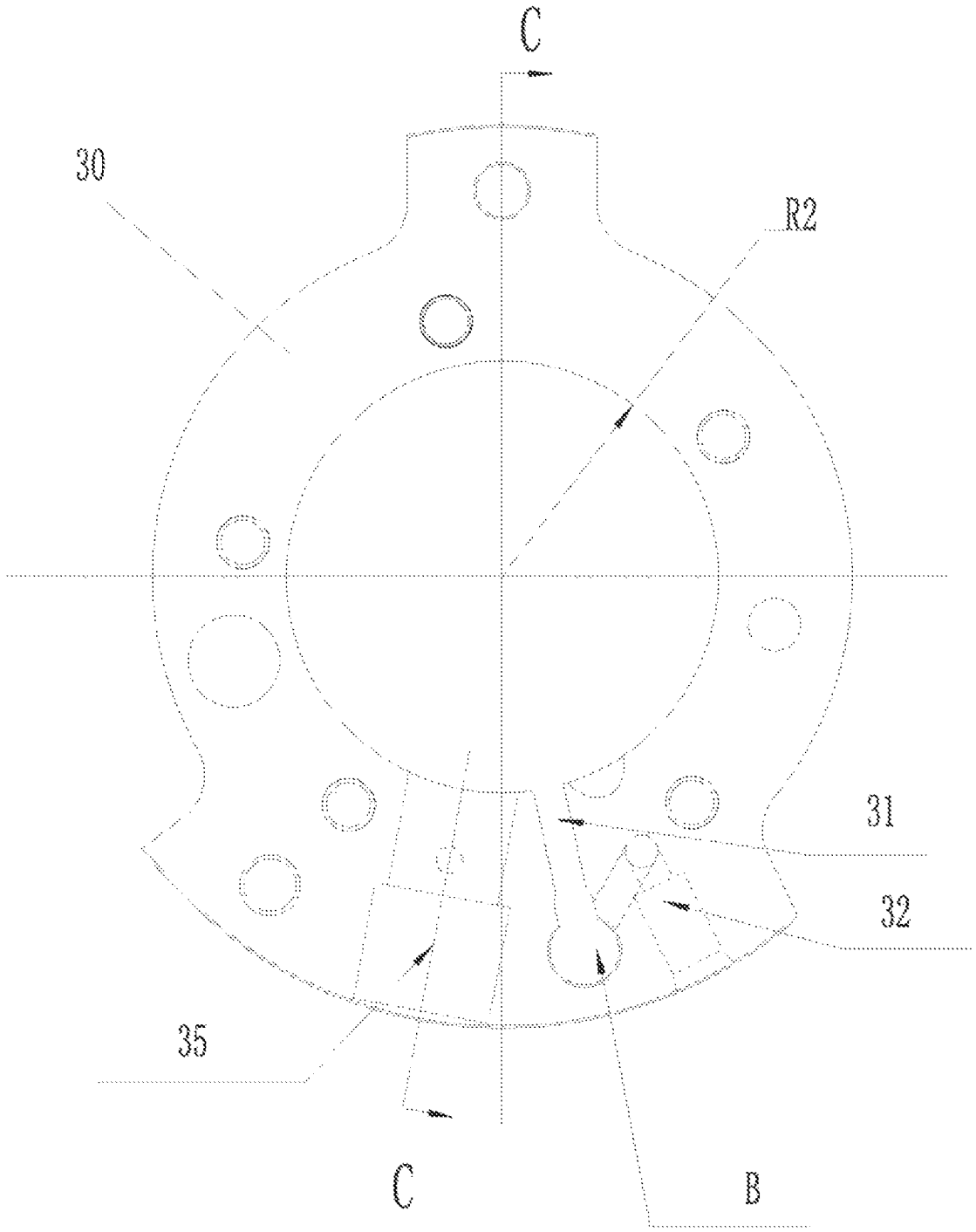
FIG. 6 is a schematic structure diagram of a second cylinder of the compressor in FIG. 1.
Figure 7:
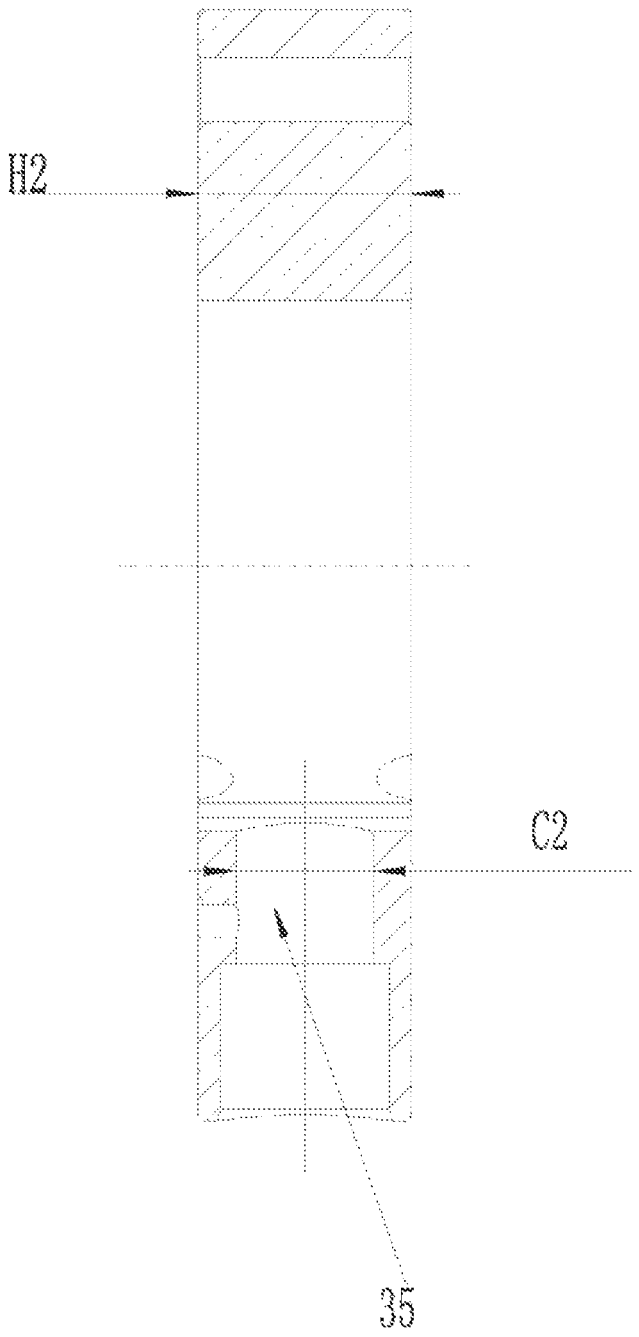
FIG. 7 is a schematic diagram illustrating a cross-sectional structure of the first cylinder along a line C-C in FIG. 3.
Figure 8:
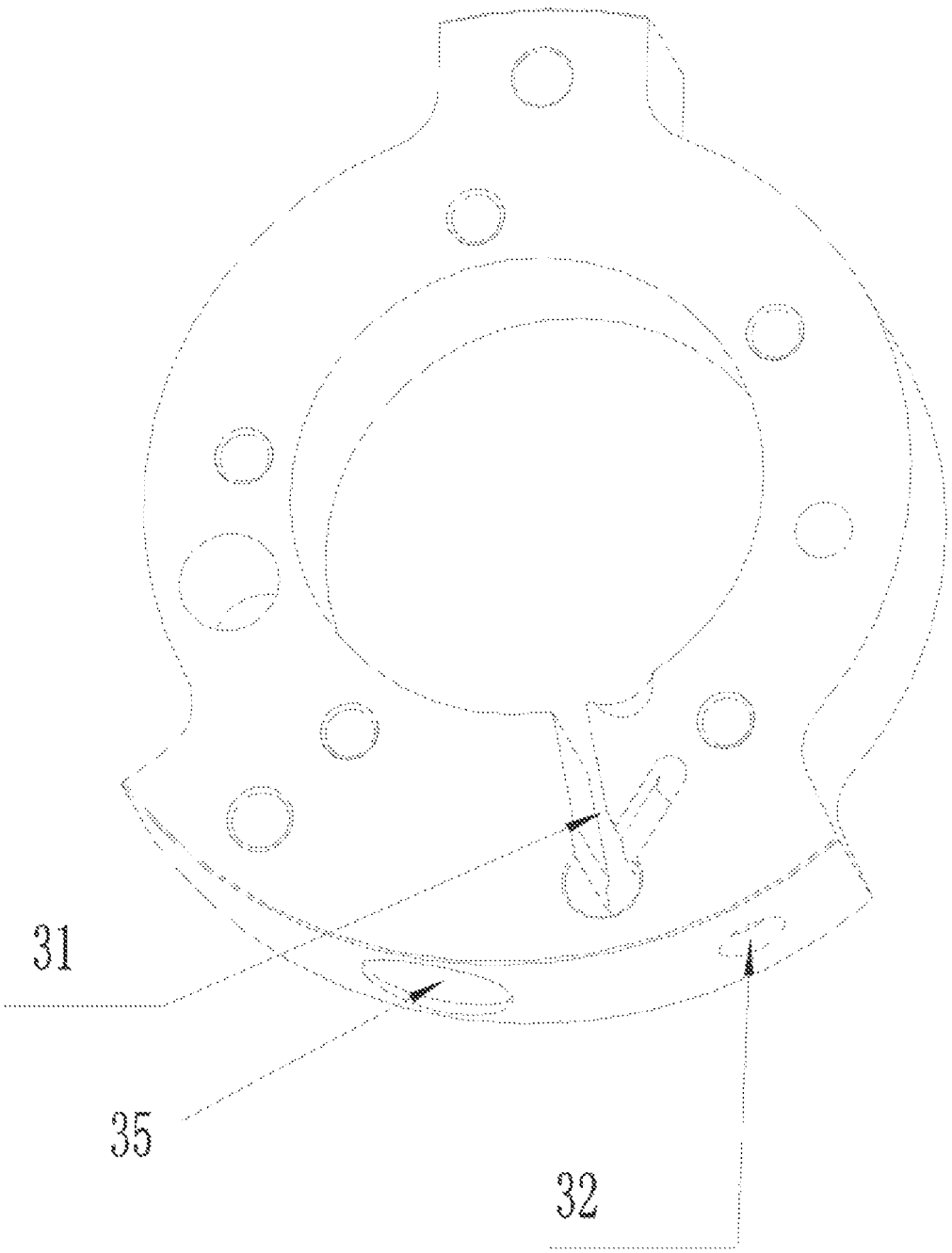
FIG. 8 is a schematic structure diagram of the second cylinder of the compressor in FIG. 1 from another view angle.
Figure 9:
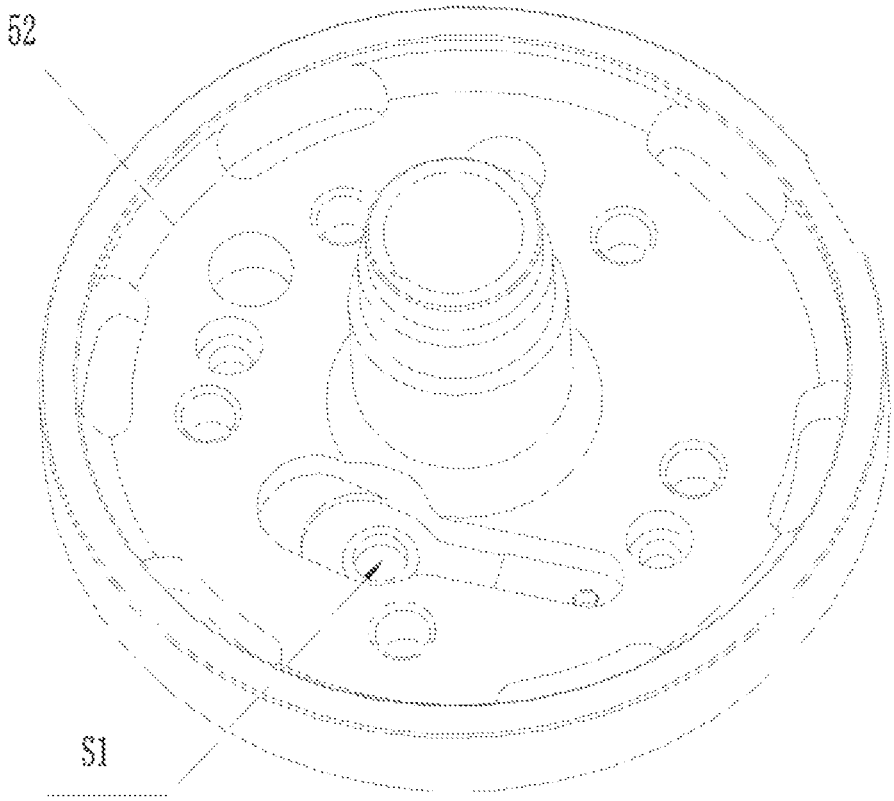
FIG. 9 is a schematic structure diagram of an upper flange of the compressor in FIG. 1.
Figure 10:
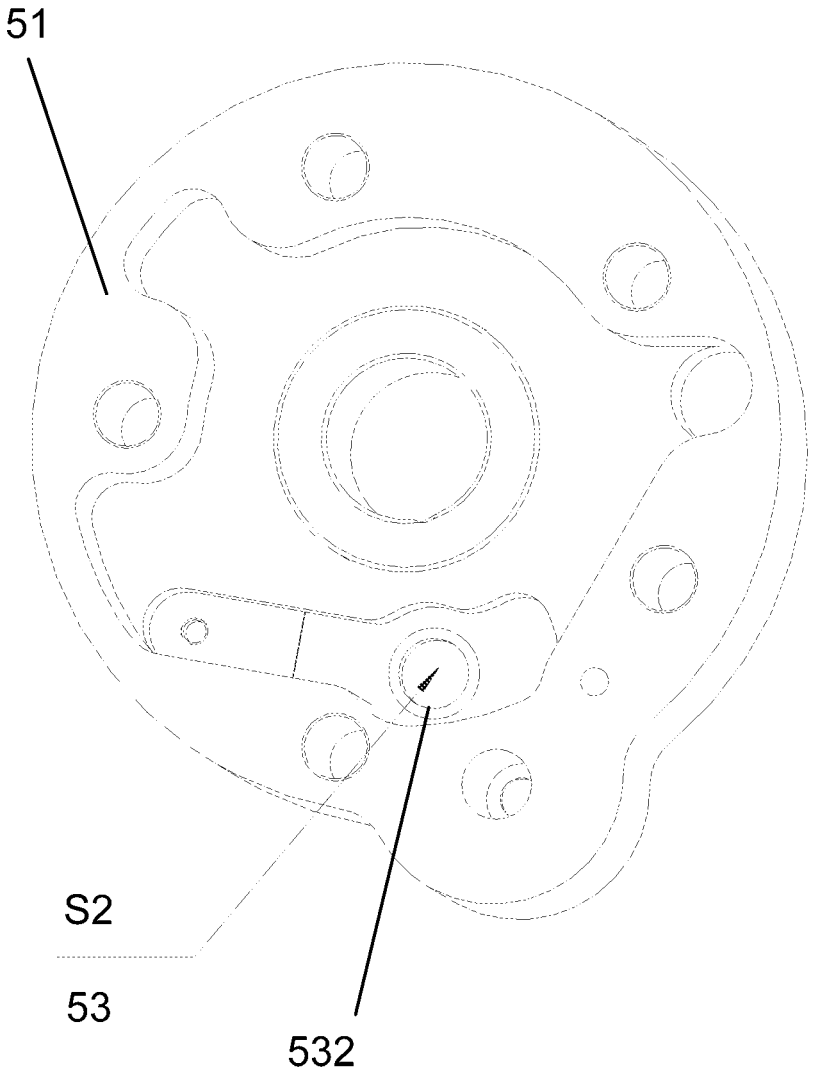
FIG. 10 is a schematic structure diagram of a lower flange of the compressor in FIG. 1.
Figure 11:
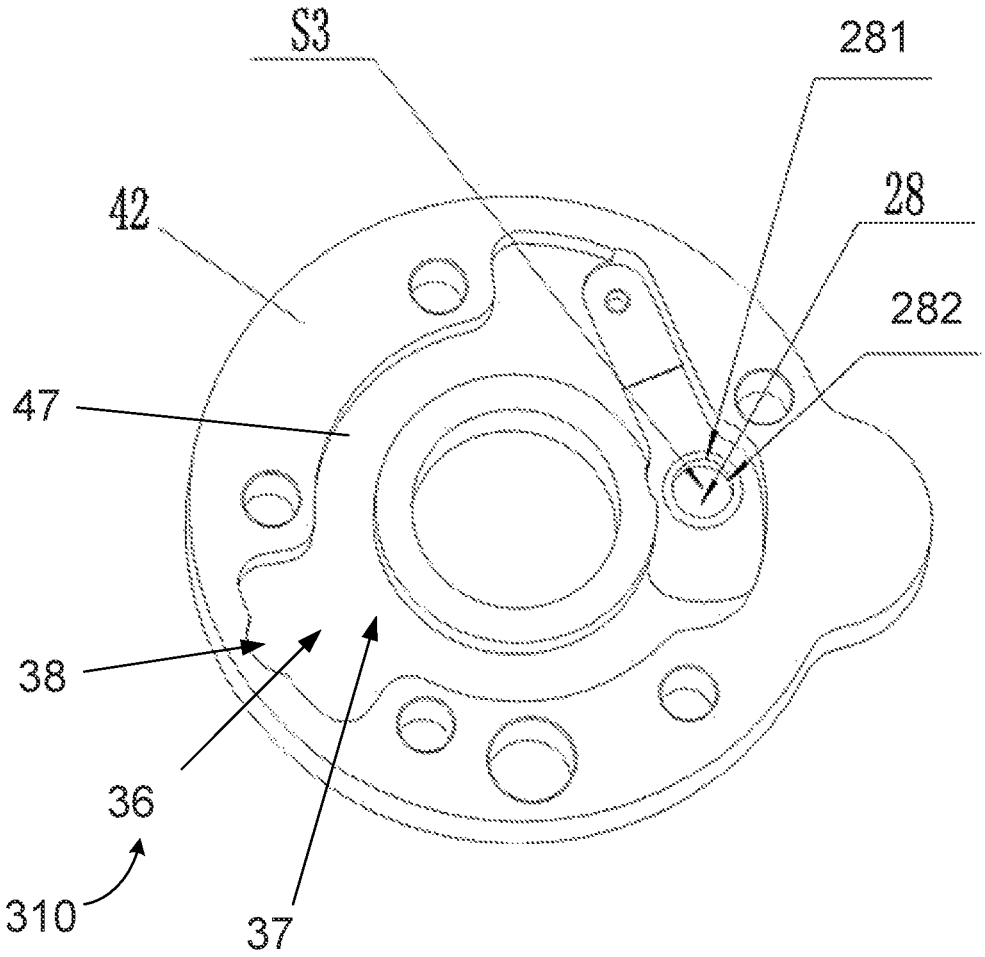
FIG. 11 is a schematic structure diagram of a second diaphragm of the compressor in FIG. 1.
Figure 12:
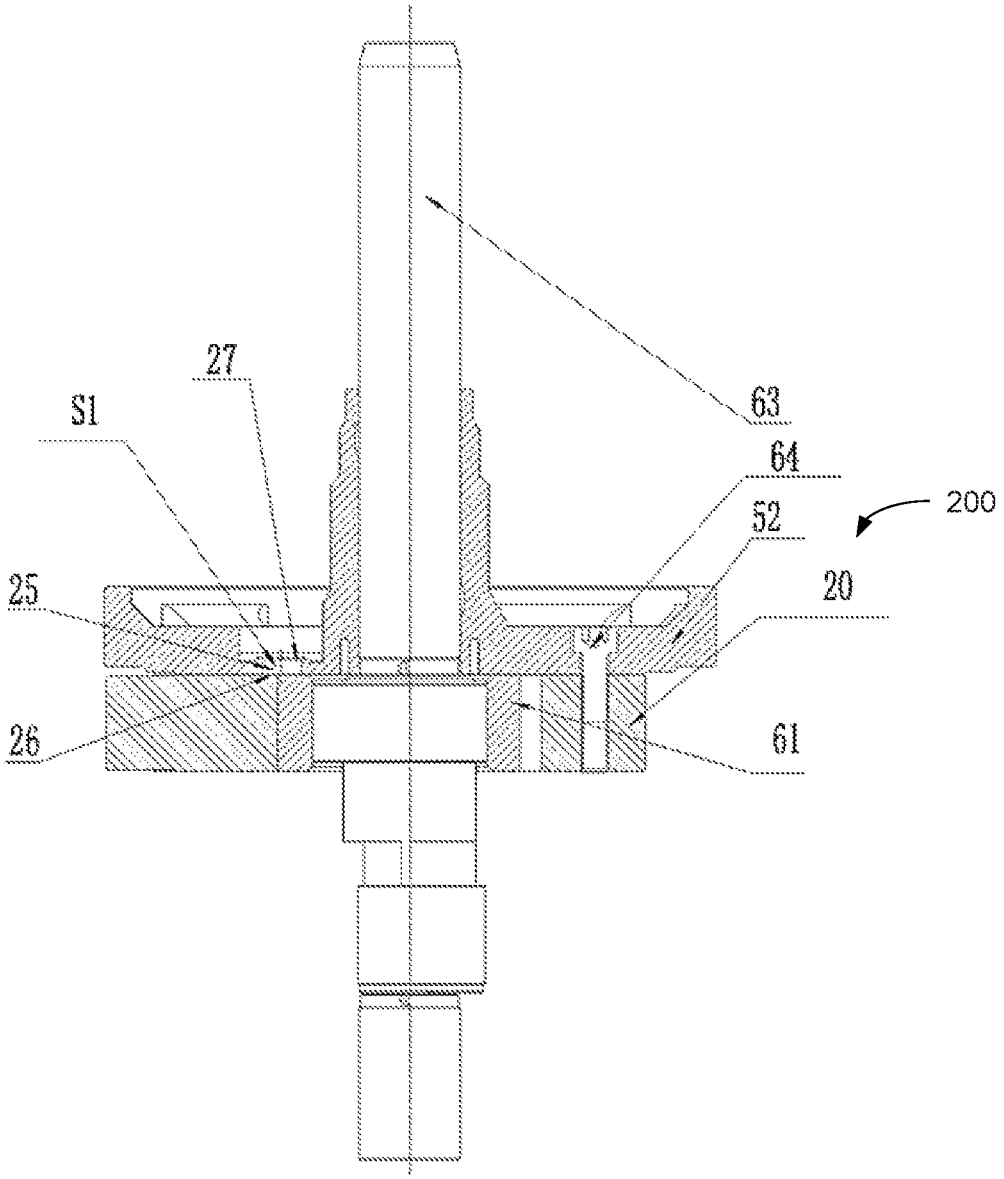
FIG. 12 is a schematic structure diagram of a first cylinder assembly of the compressor in FIG. 1.
Figure 13:
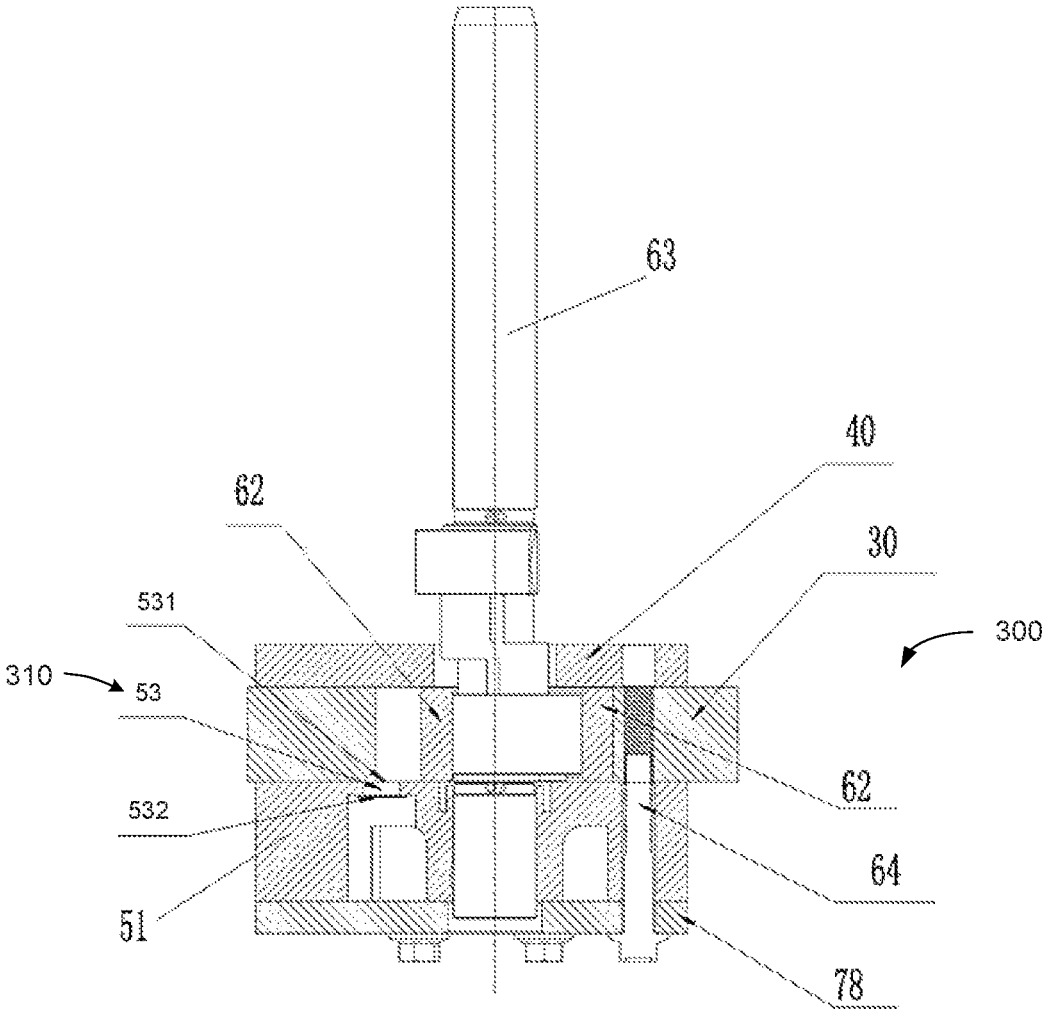
FIG. 13 is a schematic structure diagram of a second cylinder assembly of the compressor in FIG. 1.
Figure 14:
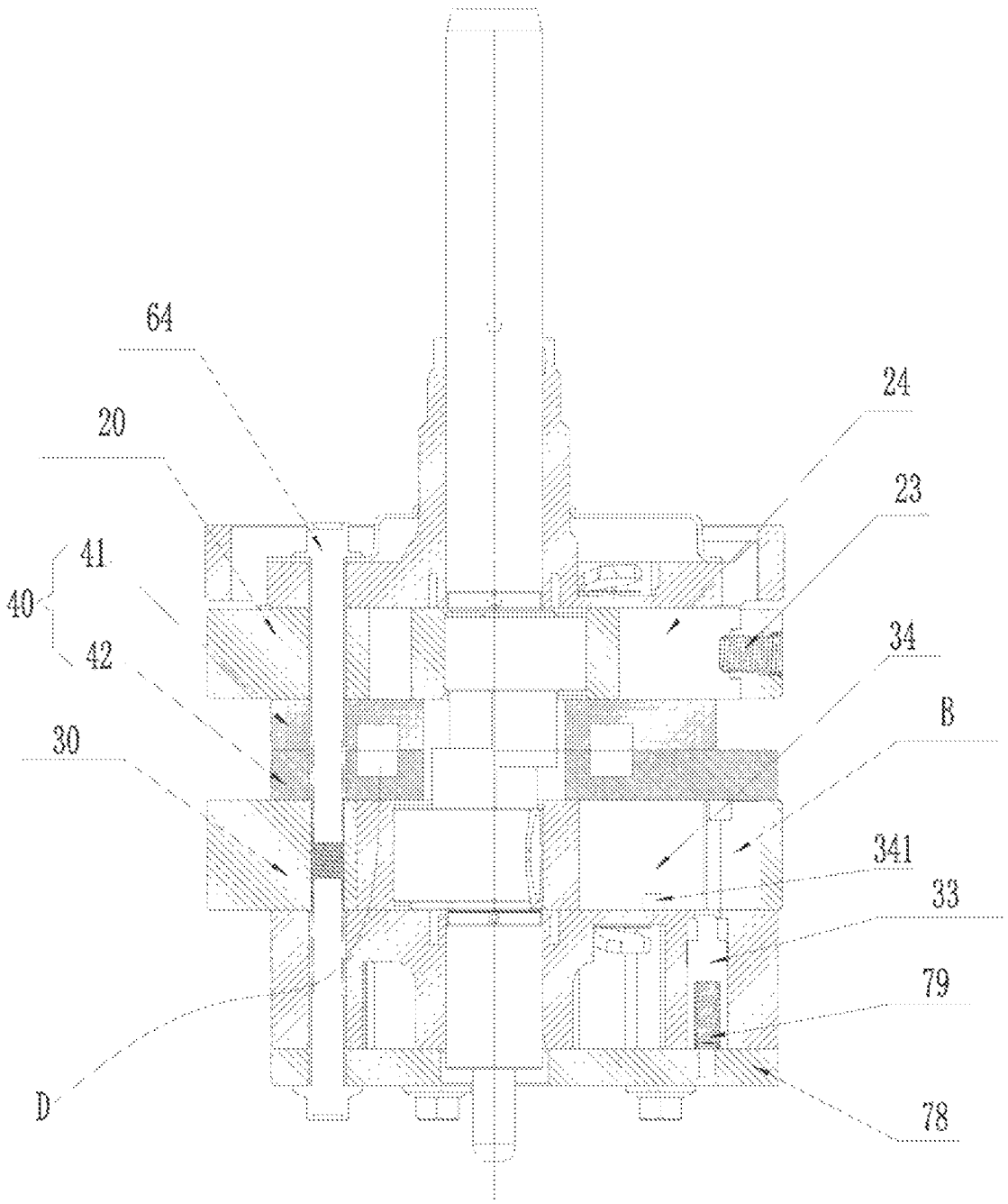
FIG. 14 is a schematic structure diagram illustrating a locking pin in an unlatched position of the compressor in FIG. 1 unlocking place.
Figure 15:
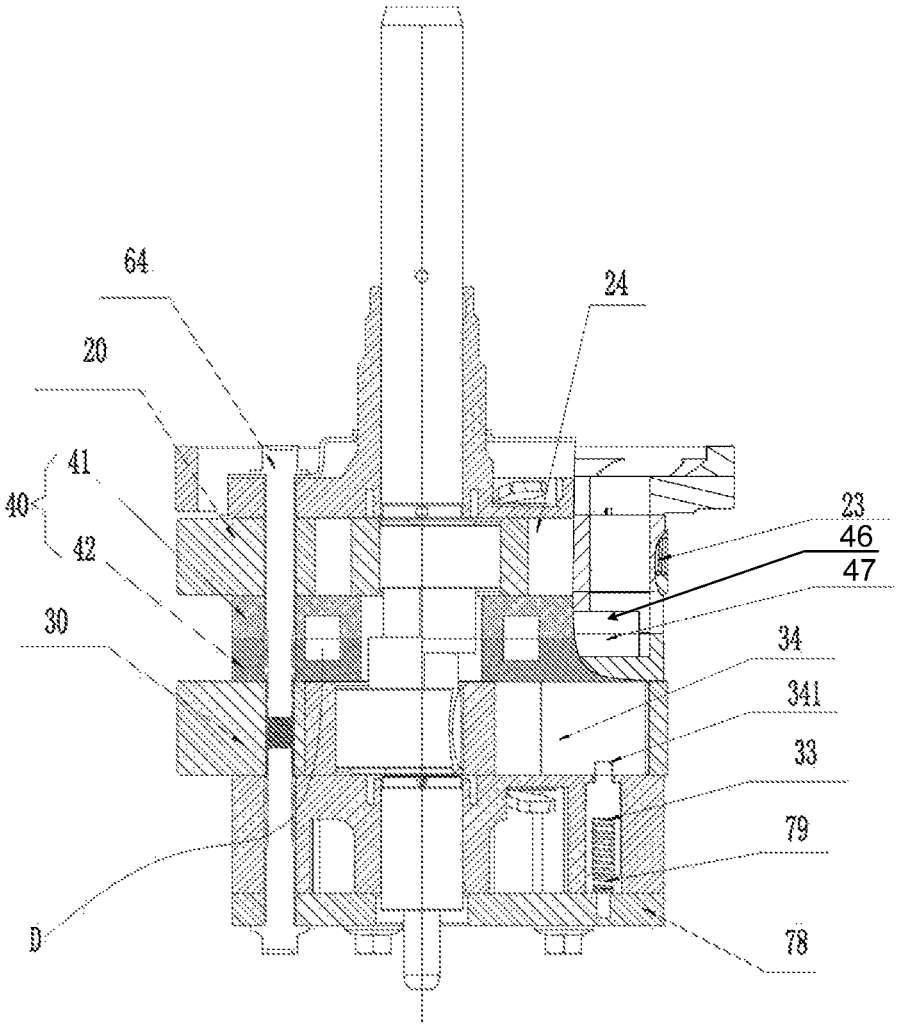
FIG. 15 is a schematic structure diagram illustrating a locking pin in a latched position of the compressor in FIG. 1 locking place.

As shown in FIG. 6 to FIG. 8, the second cylinder 30 has a sliding vane slot 31 and an intake channel 32. The second cylinder assembly further includes a sliding vane 34 and a locking pin 33. The sliding vane 34 is disposed in the sliding vane slot 31. A variable-volume control cavity is formed between an end of the sliding vane 34, which is adjacent to an outer peripheral surface of the second cylinder 30, and an inner wall of the sliding vane slot 31, As shown at a location of B in FIG. 6, the variable-volume control cavity is a confined space enclosed by the diaphragm, the second cylinder and the lower flange, and isolated from the high pressure in the housing. The first end of the intake channel 32 is in communication with the variable-volume control cavity, and the second end of the intake channel 32 is configured to introduce high-pressure refrigerant or low-pressure refrigerant. The locking pin 33 is disposed adjacent to the second cylinder 30 and located on a side of the sliding vane 34. The locking pin 33 has a locking place for locking the sliding vane 34, and the locking pin 33 has an unlocking place for releasing the sliding vane 34 from the locking place. When the sliding vane 34 is in the locking place, the second cylinder 30 is in the idling state; and when the sliding vane 34 is in the unlocking place, the second cylinder 30 is in the operating state. Such arrangements can effectively increase the reliability and practicability of the locking pin 33.

Specifically, the second cylinder assembly also has a second suction channel 35. The intake channel 32 is arranged relatively independent of the second suction passage 35. When the high-pressure refrigerant is introduced into the intake channel 32, the locking pin 33 is in the unlocking place; and when the low-pressure refrigerant is introduced into the intake channel 32, the locking pin 33 is in the locking place. Such arrangements further realize the control for the operating state of the second cylinder, and the cooling output capacity of the compressor is controlled by controlling the position of the locking pin. The structure is simple and has high reliability.

Furthermore, the first cylinder 20 is provided to be coaxial with the second cylinder 30. The second cylinder assembly further includes a diaphragm 40. The diaphragm 40 is located between the first cylinder 20 and the second cylinder 30. Such arrangements can effectively increase the sealing and stability between the first cylinder 20 and the second cylinder 30.

In order to improve the performance of the compressor, a receiving cavity body can be provided in the diaphragm 40. The receiving cavity body is configured to temporarily store the gas discharged from the discharge port of the second diaphragm, to reduce the pressure pulsation at the discharge port of the second diaphragm, to reduce the discharge loss, and improve the efficiency of the compressor.

Specifically, the diaphragm 40 includes a first diaphragm 41 and a second diaphragm 42. The first diaphragm 41 is provided with a first annular groove. The second diaphragm 42 is located under the first diaphragm 41. A surface of the second diaphragm 42, which faces the first diaphragm 41, is provided with a second annular groove. The second diaphragm 42 is disposed opposite to the first diaphragm 41, so that the first annular groove and the second annular groove form a receiving cavity body (as shown at a location of D in FIGS. 14 and 15). The second diaphragm 42 is provided with a first channel. A first end of the first channel is in communication with the receiving cavity body, and a second end of the first channel is in communication with the second cylinder 30. Such arrangements can reduce the discharge loss of the second cylinder. Because the second cylinder has a large volume, when the area of the discharge port of the second cylinder equals to the area of the discharge port of the first cylinder, the discharge loss is larger. Therefore the discharge port of the second cylinder needs arranging to be larger than the discharge port of the first cylinder.

Furthermore, the second discharge channel includes a second channel. The first diaphragm 41 and the second diaphragm 42 are provided with the second channel. One end of the second channel is in communication with the receiving cavity body, and the other end of the second channel is in communication with the receiving chamber. The refrigerant discharged from the second cylinder 30 enters the receiving cavity through the first channel, and then is discharged into the receiving chamber through the second channel. Such arrangements can effectively discharge the high-pressure refrigerant in the receiving cavity body into the receiving chamber in time.

Figure 20:
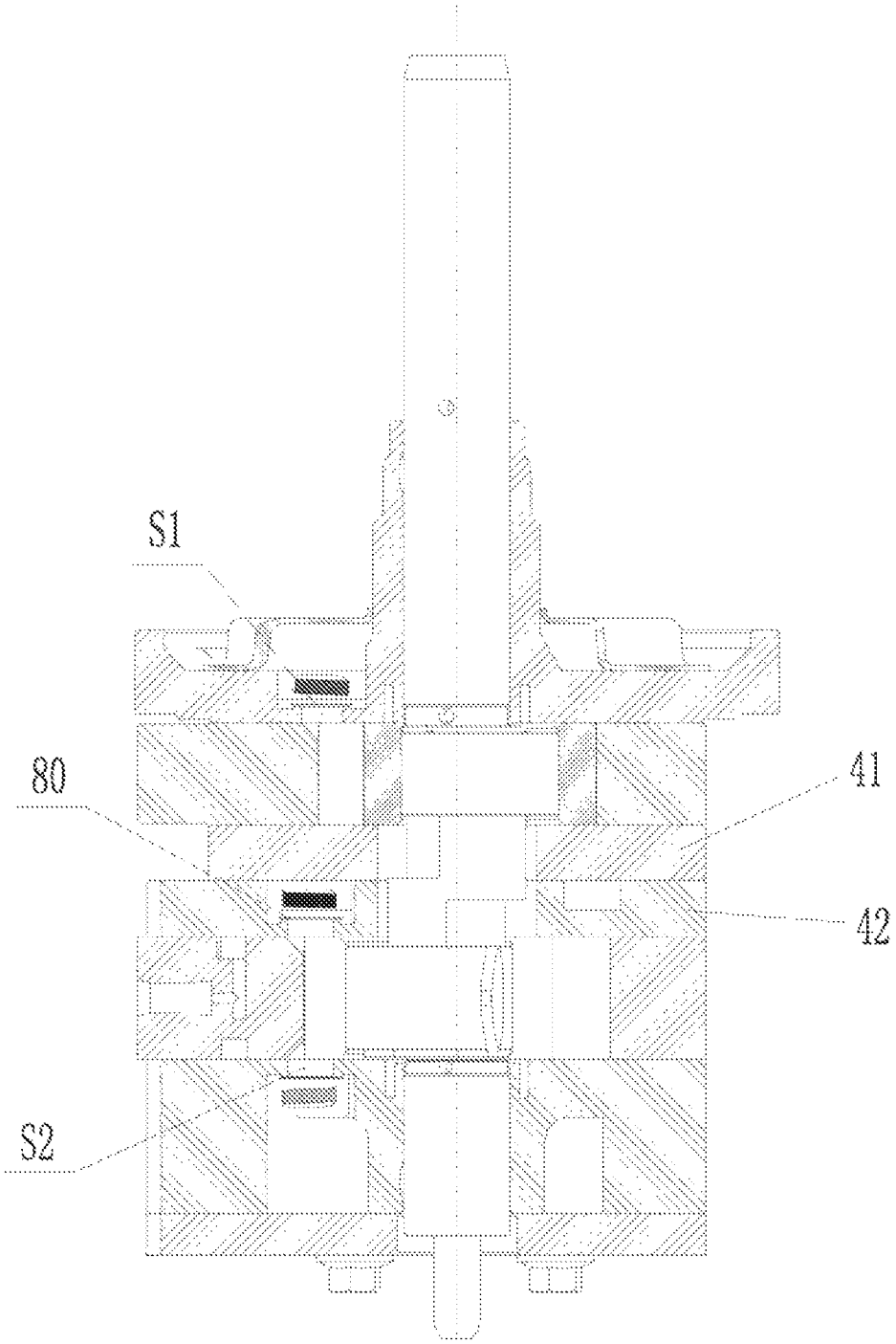
FIG. 20 is a schematic structure diagram of a pump body of an air conditioner according to an embodiment of the present disclosure.

As shown in FIG. 20, a discharge valve 80 is provided in the first channel. The discharge valve 80 has a closed position and an open position. When the discharge valve 80 is in the closed position, the second cylinder 30 is disconnected from the receiving cavity body. When the discharge valve 80 is in the open position, the second cylinder 30 is in communication with the receiving cavity body. Specifically, after the compression of the refrigerant is completed in the second cylinder 30, the discharge valve 80 is in the open position.

In the present embodiment, the second discharge channel further includes a third channel. The second cylinder assembly further includes a lower flange 51. The lower flange 51 is connected to the lower end surface of the second cylinder 30, and the lower flange 51 is provided with a third channel. A first end of the third channel is in communication with the second cylinder 30, and a second end of the third channel is in communication with the receiving chamber. The locking pin 33 is disposed in the lower flange 51. In the present embodiment, the second cylinder can discharge either through the second channel provided in the first diaphragm 41 and in the second diaphragm 42, or through the third channel provided in the lower flange 51 at the same time. Thus, the discharge capacity of the second cylinder is effectively increased, that is, the performance of the compressor is improved.

Preferably, a flow area of the first channel is the same as a flow area of the third channel. Such arrangements can effectively reduce the discharge loss of the second cylinder.

Specifically, the first cylinder assembly further includes an upper flange 52. The upper flange 52 is connected to the upper end surface of the first cylinder 20. The first discharge channel is provided in the upper flange 52. The first end of the first discharge channel is in communication with the first cylinder 20, and the second end of the first discharge channel is in communication with the receiving chamber. The sum of the minimum flow area of the first channel and the minimum flow area of the third channel is greater than or equal to the minimum flow area of the first discharge channel. Such arrangements can further improve the performance of the compressor.

Preferably, a volume ratio of the volume of the first cylinder 20 to the volume of the second cylinder 30 is Q, where the volume ratio may be set as: $0.3<Q<1$, $0.3<Q\leq0.7$ or $0.5\leq Q\leq0.7$. Such arrangements can effectively improve the cooperation of the first cylinder and the second cylinder during operation, and effectively improve the performance of the compressor.

Figure 3:
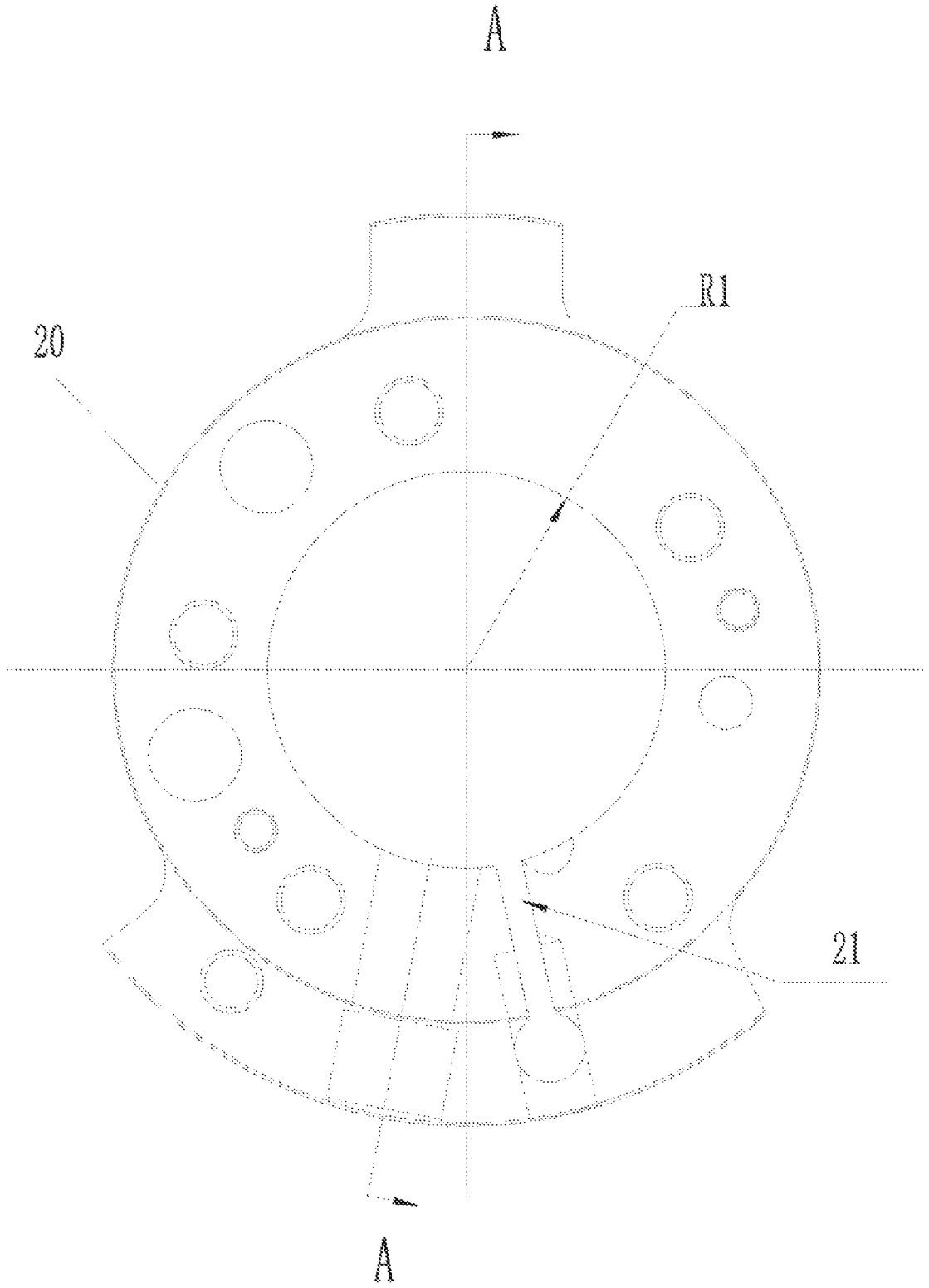
FIG. 3 is a schematic structure diagram of a first cylinder of the compressor in FIG. 1.
Figure 4:
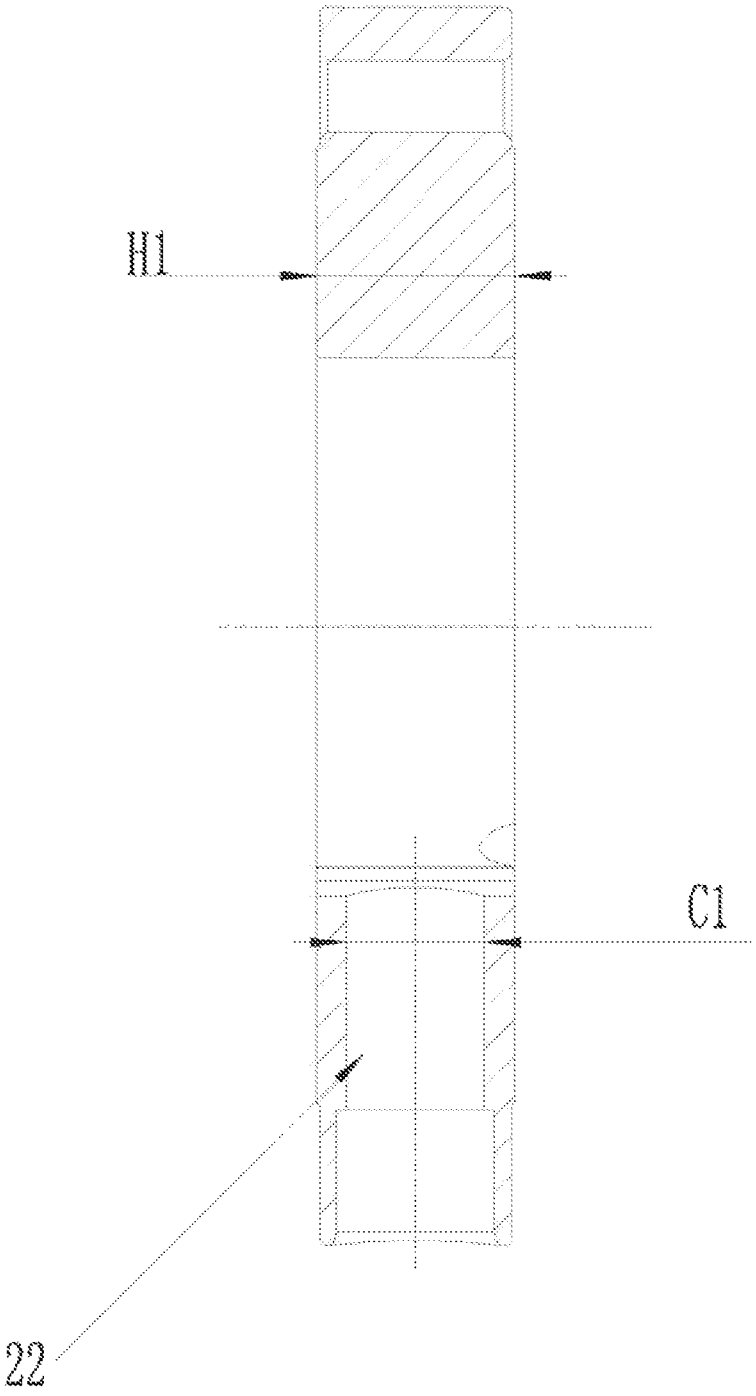
FIG. 4 is a schematic diagram illustrating a cross-sectional structure of the first cylinder along a line A-A in FIG. 3.
Figure 5:
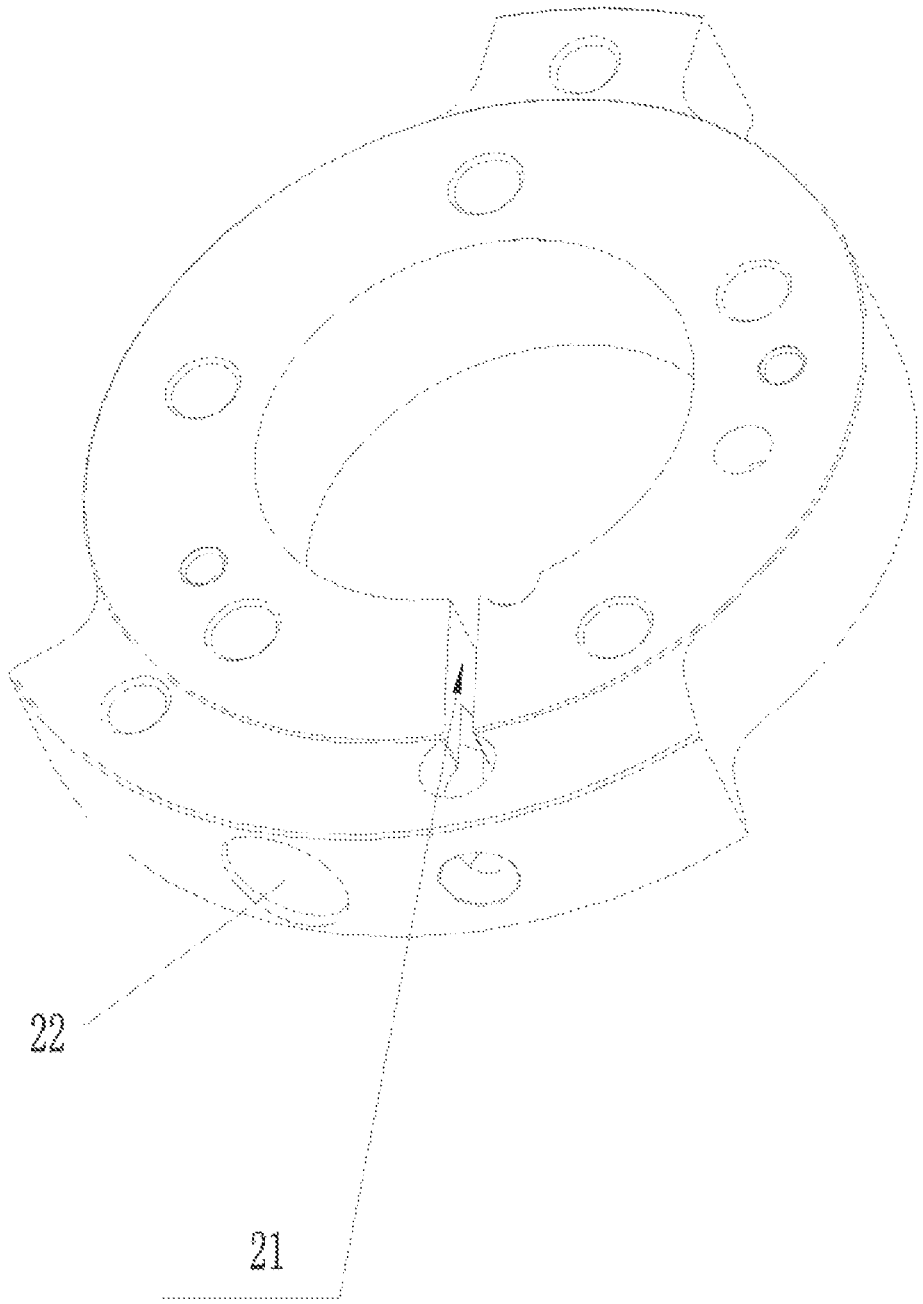
FIG. 5 is a schematic structure diagram of the first cylinder of the compressor in FIG. 1 from another view angle.

As shown in FIGS. 3 to 5, the first cylinder 20 has a first suction channel 22, and the second cylinder 30 has a second suction channel 35. The volume ratio of the volume of the first cylinder 20 to the volume of the second cylinder 30 is Q. When $0.3<Q\leq0.7$, the minimum flow area of the second suction channel 35 is larger than the minimum flow area of the first suction channel 22, and the sum of the minimum flow area of the second discharge channel and the minimum flow area of the third channel is greater than the minimum flow area of the first discharge channel. Such arrangements can further improve the efficiency or performance of the compressor.

Specifically, it is possible to further improve the compression performance of the compressor by arranging the structures of the first cylinder assembly and the second cylinder assembly. Specifically, the volume ratio of the volume of the first cylinder 20 to the volume of the second cylinder 30 may be set to be Q. When $0.3<Q<0.7$, then $R1<R2$ and $H1<H2$, where R1 is the inner diameter of the first cylinder 20; H1 is the height of the first cylinder 20; R2 is the inner diameter of the second cylinder 30; and H2 is the height of the second cylinder 30. When $0.7\leq Q<1$, then $R1=R2$ and $H1<H2$. The different volume ratios can effectively improve the low cooling output capacity of the compressor. Moreover, through arranging different cylinders to have different heights and different inner diameters, the low cooling output capacity of the compressor can be further improved, so that the energy efficiency of the multi-couple air-conditioning system provided with the compressor under the condition of the low cooling capacity output is 60% higher than the energy efficiency of a common multi-couple air-conditioning system, thereby solving the problem of low energy efficiency of the existing multi-couple air-conditioning system under the condition of the low cooling capacity output.

As shown in FIGS. 12 to 15, the compressor further includes a first roller 61, a second roller 62 and a rotating shaft 63. The first roller 61 is disposed in the first cylinder 20. The second roller 62 is disposed in the second cylinder 30. The rotating shaft 63 sequentially passes through the first cylinder 20, the diaphragm 40 and the second cylinder 30, and is connected to the first roller 61 and the second roller 62. The inner diameter of the first roller 61 is r1; the inner diameter of the second roller 62 is r2; the inner diameter of the diaphragm 40 is r3; and the volume ratio of the volume of the first cylinder 20 to the volume of the second cylinder 30 is Q. When $0.3<Q<0.7$, then $r1<r3<r2$; when $0.7\leq Q<1$, then $r1=r2<r3$. In the present embodiment, different inner diameters are configured for different volume ratios, so that the assembling problem of a pump body, which occurs when the volume ratio is too small and the height H1 of the first cylinder is too low, is solved, and that the minimum cooling output capacity of the multi-couple air-conditioning system provided with the compressor reaches 5% of the rated cooling capacity, thereby completely solving the problem of frequent shutdown and startup of the compressor due to excessive output of the minimum cooling output capacity of the compressor, reducing indoor temperature fluctuation and improving the environmental comfort. The compressor with this technology is applied in a single-split air conditioning system, and can reduce the minimum cooling output capacity of the system and improve the energy efficiency level under the condition of low cooling capacity.

The compressor in the above embodiment can also be used in the technical field of air conditioner device, that is, according to another aspect of the present invention, an air conditioner is provided. The air conditioner includes a compressor, which is the compressor in the above-described embodiment. Specifically, the compressor includes a housing 10, a first cylinder assembly and a second cylinder assembly. The housing 10 has a receiving chamber. The first cylinder assembly is disposed in the housing 10. The first cylinder assembly includes a first cylinder 20. The first cylinder assembly has a first discharge channel. The first end of the first discharge channel is in communication with the first cylinder 20, the second end of the discharge channel is in communication with the receiving chamber. The second cylinder assembly is disposed in the housing 10, and the second cylinder assembly includes a second cylinder 30. The second cylinder 30 is disposed adjacent to the first cylinder 20. The second cylinder assembly has a second discharge channel, and the second discharge channel is arranged relatively independent of the first discharge channel. The first end of the second discharge channel is connected to the second cylinder 30, and the second end of the second discharge channel is in communication with the receiving chamber. When the first cylinder 20 is in the operating state, the second cylinder 30 is in the operating state, or the second cylinder 30 is in the idling state.

In the technical solution of the present embodiment, when the first cylinder 20 is in the operating state, the second cylinder 30 is configured to have an operating state, in which it operates simultaneously with the first cylinder 20, and the second cylinder 30 is configured to have an idling state when the is idling. Thus the air-conditioning system having the compressor can adjust the second cylinder 30 to be in the operating state or in the idling state according to the required indoor cooling capacity, and make the first cylinder 20 remain the operating state, thereby making the compressor remain the working state without shutdown, avoiding the problem in the prior art that all cylinders in the compressor are shut down when the required indoor cooling capacity reaches a preset value, and improving the practicability and the reliability of the compressor.

When the first cylinder 20 and the second cylinder 30 simultaneously operate (denoted as a mode one), $10\ HZ<f1<120\ HZ$, where f1 is the operating frequency of the compressor. When the second cylinder 30 is in the idling state (denoted as a mode two), then $10\ HZ<f2<70\ HZ$, where f2 is the operating frequency of the compressor. The multi-couple air-conditioning system provided with the compressor operates at a high frequency in the mode one when the demand for cooling capacity is larger, to achieve rapid refrigeration.

Specifically, the air conditioner structure includes a liquid separator 76, a throttle valve 72, a housing 10, a motor 77 (including a stator and a rotor) and a pump body assembly. The liquid separator 76 is disposed outside the housing. The motor 77 and the pump body assembly are disposed inside the housing. The pump body assembly is located under the motor 77. The pump body assembly is provided with an upper flange located at an upper part of the pump body, a lower flange located at a lower part of the pump body, a lower cover plate 78, a rotating shaft, a compression cylinder, a first roller 61, a second roller 62, a sliding vane 24 and a sliding vane 34. The sliding vane 34 is provided with a sliding vane locking slot 341 and a diaphragm. The pump body assembly is connected to the motor rotor by a rotating shaft, and is driven by the rotor to compress the gas. The pump body assembly has a plurality of compression cylinders, at least one of which is a variable-volume compression cylinder, i.e., a second cylinder, and at least one of which is a invariable-volume compression cylinder, i.e., a first cylinder. Such a structure has two operation modes, i.e., the mode one and the mode two. When operating in the mode one, the variable-volume compression cylinder and the invariable-volume compression cylinder operate at the same time. When operating in the mode two, the variable-volume compression cylinder does not operate, and the invariable-volume compression cylinder continues to operate. The volume V2 of the variable-volume compression cylinder, i.e., the volume of gas discharged from the variable-volume compression cylinder per revolution of the rotating shaft, is larger than the volume V1 of the invariable-volume compression cylinder, i.e., the volume of gas discharged from the invariable-volume compression cylinder per revolution of the rotating shaft, and the volume ratio Q satisfies the equation Q=V1/V2, where Q satisfies: 0.3<V1/V2<1.

In order to further reduce the vibrations of the compressor and improve the reliability of the compressor, and meanwhile ensure that the compressor has a higher energy efficiency, the volume ratio can be set in a range of 0.5<V1/V2<0.7.

The invariable-volume compression cylinder is disposed above the variable-volume compression cylinder and adjacent to the upper flange. The invariable-volume compression cylinder and the variable-volume compression cylinder are separated by a diaphragm. When the volume ratio Q satisfies 0.3<V1/V2≤0.7, the minimum flow area C2 of the second suction channel of the variable-volume compression cylinder is greater than the minimum flow area C1 of the first suction channel of the invariable-volume compression cylinder; the minimum flow area of the discharge port for discharging the compressed gas in the variable-volume compression cylinder is larger than the minimum flow area of the discharge port for discharging the compressed gas in the invariable-volume compression cylinder; when 0.7<V1/V2<1, the area of the discharge port of the variable-volume compression cylinder is equal to the area of the discharge port of the invariable-volume compression cylinder.

The diaphragm can be provided as two parts: a first diaphragm 41 and a second diaphragm 42. The first diaphragm 41 is adjacent to the invariable-volume compression cylinder, and the second diaphragm 42 is adjacent to the variable-volume cylinder. The second diaphragm 42 is additionally provided with a discharge port for discharging the compressed gas in the variable-volume compression cylinder, and the area S3 of the discharge port is equal to the area S2 of the discharge port in the lower flange.

When 0.3<V1/V2<0.7, the connecting modes between various parts are as follows.

I. The upper flange is fixed to the invariable-volume compression cylinder with two to three centering screws 64 and screwed onto the invariable-volume compression cylinder, to form an invariable-volume cylinder assembly.

II. the lower flange and the lower cover plate are fixed to the variable-volume cylinder with n (n=4 to 8) centering screws 64 and screwed onto the variable-volume compression cylinder, to form a variable-volume cylinder assembly;

III. The n combining screws pass through the upper flange, the invariable-volume compression cylinder and the diaphragm in sequence, and are screwed onto the variable-volume compression cylinder, to form a pump body assembly.

Specifically, the method for assembling the compressor includes the following steps: the upper flange 52 is mounted on the first cylinder 20 with a first centering screw; the lower flange 51 and the lower cover 78 are sequentially mounted on the second cylinder 30 with the second centering screw; then the combining screw sequentially passes through the upper flange 52, the first cylinder 20 and the diaphragm 40, and is screwed onto the second cylinder 30. Preferably, the number of the first centering screws is N1, where 2≤N1≤3, and the number of the second centering screws is N2, where 4≤N2≤8.

The motor of the compressor is a variable-frequency motor, and the air conditioner can adjust the operating frequency and the operating mode of the compressor according to the demand for the indoor cooling capacity. When the demand for the cooling capacity is larger, the compressor operates according to the mode one to while increasing the operating frequency thereof. When the demand for the cooling capacity is smaller, the compressor operates according to the mode two while decreasing the operating frequency thereof. A frequency range of the compressor when operating in the mode one is 10 Hz to 120 Hz, and a frequency range of the compressor when operating in the mode two is 10 Hz to 70 Hz.

The structure of the compressor structure and the refrigerant circulation process are as follows: the compressor includes a liquid separator, a housing, a motor and a pump body assembly; the motor is disposed at an upper position inside the housing, and the pump body assembly is disposed at a lower position inside the housing; the rotor drives the rotating shaft to rotate to compress the gas sucked into the variable-volume or invariable-volume compression cylinder, and the compressed gas is discharged into the housing of the compressor through a corresponding discharge port, and passes through the four-way valve 73 to enter the heat exchanger 71 or the heat exchanger 71' to perform the hear exchange with the external environment, and then enters the liquid separator to return to the suction port of the variable-volume compression cylinder or the invariable-volume compression cylinder. As for the heat exchanger 71 and the heat exchanger 71', one is configured to absorb heat, and the other is configured to exchange heat.

The invariable-volume cylinder assembly includes an invariable-volume compression cylinder, an upper flange, a first roller 61, a sliding vane 24 and a spring 23. Two centering screws pass through the upper flange and connects the upper flange to the invariable-volume compression cylinder to be a whole. The sliding vane 24 is disposed in the sliding vane slot 21 of the invariable-volume compression cylinder. The second roller 62 is disposed in the invariable-volume compression cylinder and is sleeved on the rotating shaft. The sliding vane 24 and the second roller 62 abut against each other.

The variable-volume cylinder assembly includes a variable-volume compression cylinder, a lower flange, a lower cover plate, a second roller 62 and a sliding vane 34. The locking pin includes a return spring 79. Five centering screws sequentially pass through the lower cover plate and the lower flange, and connect the lower cover and the loser flange to the variable-volume compression cylinder to be whole. The sliding piece 34 is arranged in the sliding vane slot 31 of the variable-volume compression cylinder. The first roller 61 is arranged in the variable-volume compression cylinder and is sleeved on the rotating shaft. The sliding vane 34 and the first roller 61 abut against each other.

The pump body assembly includes an invariable-volume cylinder assembly, a variable-volume cylinder assembly, a diaphragm and a rotating shaft. Five combining screws sequentially pass through the invariable-volume cylinder assembly and the diaphragm, which are then locked on the variable-volume compression cylinder, to connect the invariable-volume cylinder assembly to the variable-volume cylinder assembly to be a whole and to form the pump body assembly.

A mode conversion mechanism includes a sliding vane 34, a locking pin and a return spring. The sliding vane 34 is disposed in the sliding vane slot 31 of the variable-volume compression cylinder. The variable-volume compression cylinder, the diaphragm and the lower flange enclose the rear portion of the sliding vane 34 to form a closed variable-volume control cavity. A gas flow channel, i.e., an intake channel, is provided in the variable-volume compression cylinder. One end of the gas flow channel is in communication with the variable-volume control cavity, and the other end is configured to be a pressure inlet. A sliding vane locking slot is provided on the sliding vane 34 and is adjacent to the lower flange. A locking pin and a return spring are disposed in the lower flange on the lower side of the sliding vane 34 in a vertical direction. The pressure on a side of the locking pin, which is adjacent to the lower cover side, is a constant low pressure (equal to the pressure at the suction port of the variable-volume compression cylinder or the pressure at the suction port of the invariable-volume compression cylinder). Another side of the locking pin, which is adjacent to the variable-volume compression cylinder, is in communication with the variable-volume control chamber, thus the pressure on the other side of the locking pin equals to the pressure in the variable-volume control cavity.

Mode conversion: when the operating frequency of the compressor is higher than 60 HZ to 70 HZ, and when the operating mode of the compressor is the mode two (i.e., the invariable-volume compression cylinder operates while the variable-volume compression cylinder is idling), the high pressure valve 74 is turned on, and the low pressure valve 75 is closed. The high-pressure gas (the compressed gas discharged from the compression chamber) sequentially passes through the pressure inlet of the intake channel, and then enters the variable-volume control chamber, so that the pressure on the rear portion of the sliding vane 34, and the pressure at the other side of the locking pin, which is adjacent to the variable-volume compression cylinder, become high pressures; the locking pin moves downwards and away from the sliding vane locking slot on the sliding vane 34; the compressor is converted into the mode one to operate, and the variable-volume compression cylinder and the invariable-volume cylinder operate simultaneously. At this time, the operating capacity of the compressor is V1+V2 (as shown by the curve Q(x) in FIG. 16), and the compressor outputs a larger cooling capacity. When the operating frequency of the compressor is lower than 20 HZ to 30 HZ, and when the operating mode of the compressor is the mode one (i.e., the variable-volume compression cylinder and the invariable-volume compression cylinder operate simultaneously), the high pressure valve 74 is closed while the low pressure valve 75 is turned on, and the low-pressure gas, whose pressure equals to the pressure at the suction port of the variable-volume compression cylinder or the pressure at the suction port of the invariable-volume compression cylinder, enters the variable-volume control cavity through the pressure inlet and the gas flow channel, so that the pressure at the rear portion of the sliding vane 34, and the pressure at the other side of the locking pin, which is adjacent to the variable-volume compression cylinder, become low pressures; the locking pin moves upwards approaching to the sliding vane 34 and enters the sliding vane locking slot, to prevent the sliding vane 34 from reciprocating movement; the compressor is converted into the mode two to operate; the variable-volume compression cylinder does not operate, that is the variable-volume compression cylinder no longer inhales, compresses and discharges the gas as the rotating shaft rotates; the invariable-volume cylinder continues to operate; the compressor has an operating capacity of V1 and outputs a smaller cooling capacity.

Figure 16:
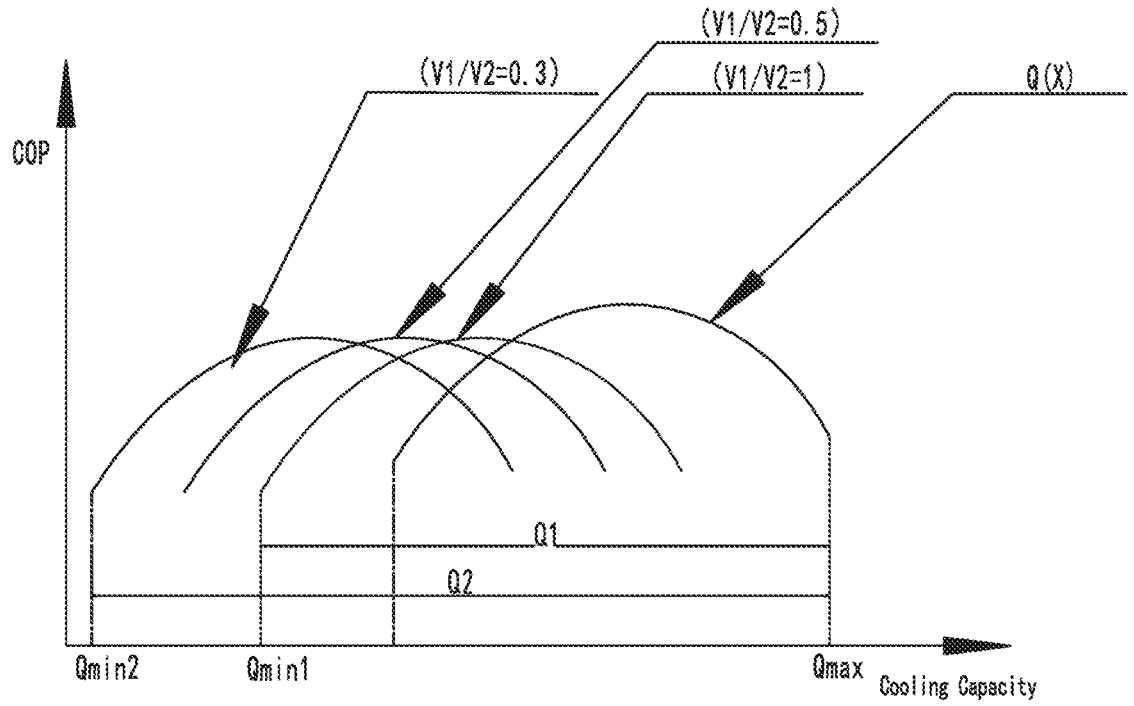
FIG. 16 is a schematic curve graph illustrating cooling output capacity ranges when the first cylinder and the second cylinder of the compressor in FIG. 1 have different volume ratios.
Figure 17:
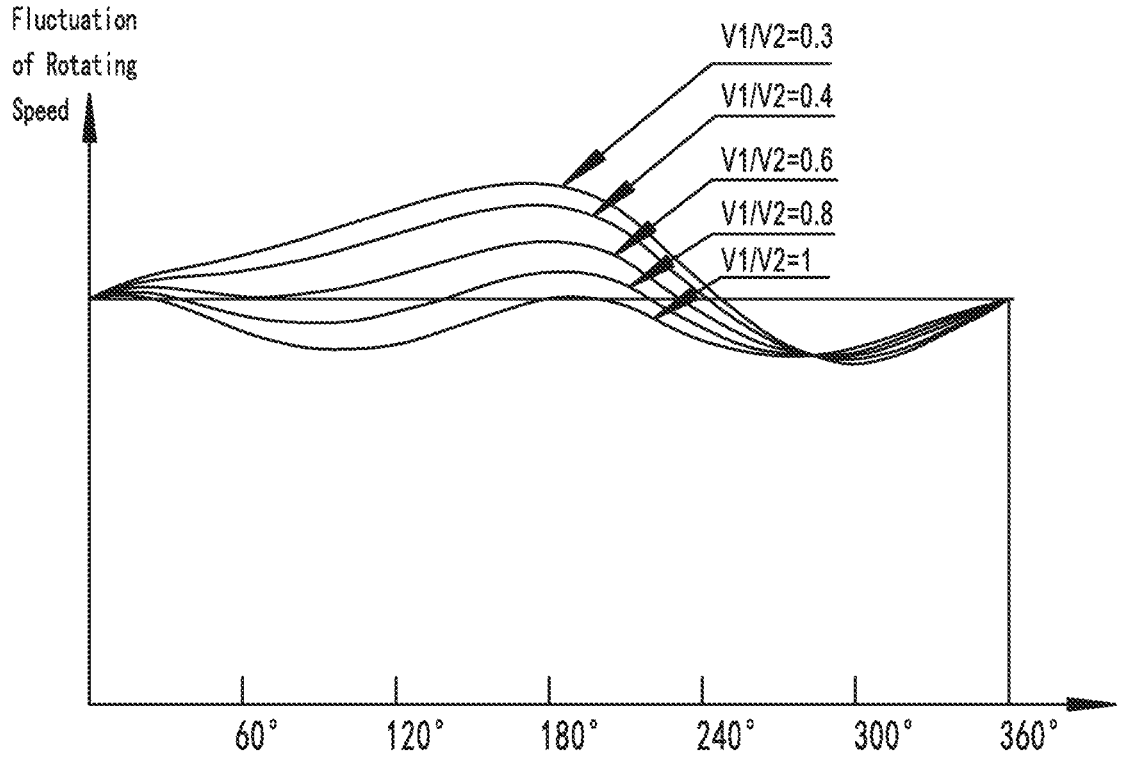
FIG. 17 is a schematic curve graph illustrating fluctuations of rotating speeds of a rotating shaft when the first cylinder and the second cylinder of the compressor in FIG. 1 have different volume ratios and are simultaneously operated.
Figure 18:
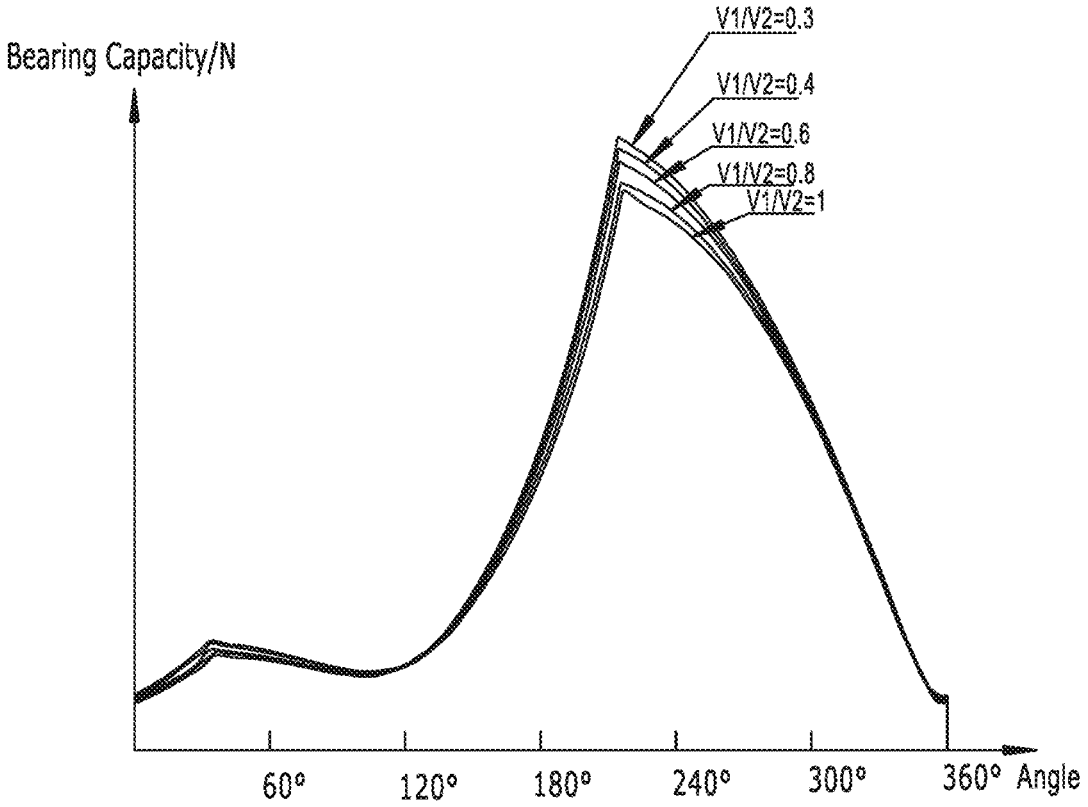
FIG. 18 is a schematic curve graph illustrating a bearing capacity of a lower flange when the first cylinder and the second cylinder of the compressor in FIG. 1 have different volume ratios.
Figure 19:
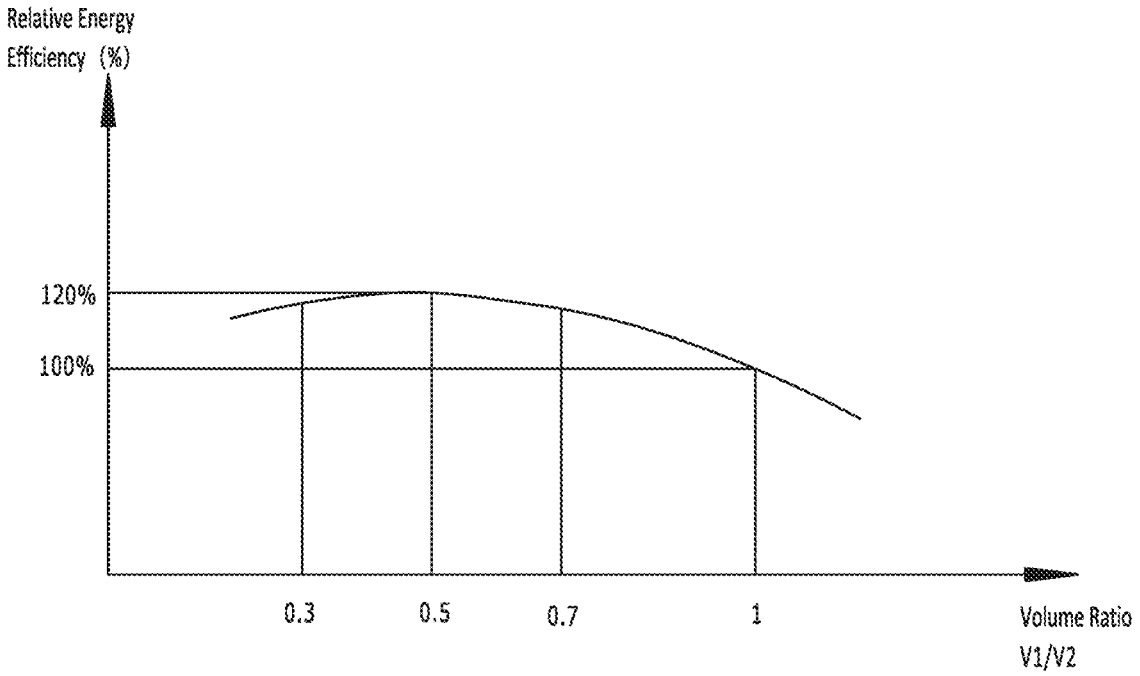
FIG. 19 is a schematic curve graph illustrating a trend of change of energy efficiency of the compressor in FIG. 1 when the first cylinder and the second cylinder have same volume ratios.

Setting of the volume ratio V1/V2: as shown in FIG. 16, when the compressors with different volume ratios V1/V2 operate in the mode one and have equal total capacity (V1+V2), the maximum cooling output capacities ($Q_{max}$) thereof are equal. However, if the volume ratio V1/V2 is smaller, then the minimum cooling output capacity of the compressor operating in the mode two is smaller, and the corresponding cooling capacity range is larger, and it is more advantageous for accurately controlling the indoor temperature and reducing the shutdown and startup frequency of the compressor and the energy efficiency of the compressor is higher (as shown in FIG. 19). If the volume ratio V1/V2 is smaller, then when the compressor operates in the mode one, the fluctuation of the compressor rotational speed in one cycle is greater (as shown in FIG. 17), resulting in greater vibrations of the compressor, which is disadvantageous to smooth operation of the compressor. In addition, if the bearing force of the lower flange is greater (as shown in FIG. 18), the reliability of the compressor deteriorates. It is verified by experiments that, when the volume ratio satisfies V1/V2>0.3, it can ensure that the minimum cooling capacity meets the demand, and that the compressor can also stably and reliably operate in the mode one. Accordingly, the volume ratio V1/V2 cannot be set to be too large, because too large volume ratio may cause the minimum cooling capacity output to be too large when the compressor operates in the mode one and cause the energy efficiency of the compressor to be decreased. Therefore, a proper volume ratio satisfies 0.3<V1/V2<1. As can be seen from FIG. 17 and FIG. 18, when 0.5<V1/V2<0.7, the fluctuation of the compressor rotational speed when the compressor operates in the mode one and the bearing force of the lower flange are not too high, and more beneficially, the energy efficiency of the compressor is at a relatively higher level (as shown in FIG. 19), therefore, the compressor with the volume ratio V1/V2 also has the advantages of small vibration of the compressor, high reliability, and high energy efficiency of the compressor.

As for the minimum flow area of the suction channel and the minimum flow area of the discharge channel, the minimum flow area of the suction channel refers to the minimum projected area of the normal planes of the suction channel, each of which goes through a center of the suction channel, and the flow area of the discharge channel refers to the minimum projected area of the normal planes of the discharge channel, each of which goes through a center of the discharge channel.

The arrangement of the suction channel and the discharge channel: as for the invariable-volume compression cylinder, the cylinder volume thereof V1 is smaller, and compared with the variable-volume compression cylinder, the suction and discharge resistance losses of the invariable-volume compression cylinder are smaller. The minimum flow area of the first suction channel is a smaller C1, and the flow area of the first discharge channel is S1, which is not only advantageous for improving the structural strength of the invariable-volume compression cylinder, but also advantageous for improving the performance of the compressor. As for the variable-volume compression cylinder, the cylinder volume V2 thereof is larger, and the variable-volume compression cylinder operates only when the demand for cooling capacity is larger, and the operating frequency of the variable-volume compression cylinder is higher when it operates. Therefore, the minimum flow area of the second suction channel should be a larger C2, and the flow area of the third channel is S2. The relationships between the cross sections of the suction channels and the discharge channels of the two compression cylinders are that C1<C2, and S1<S2.

Figure 2:
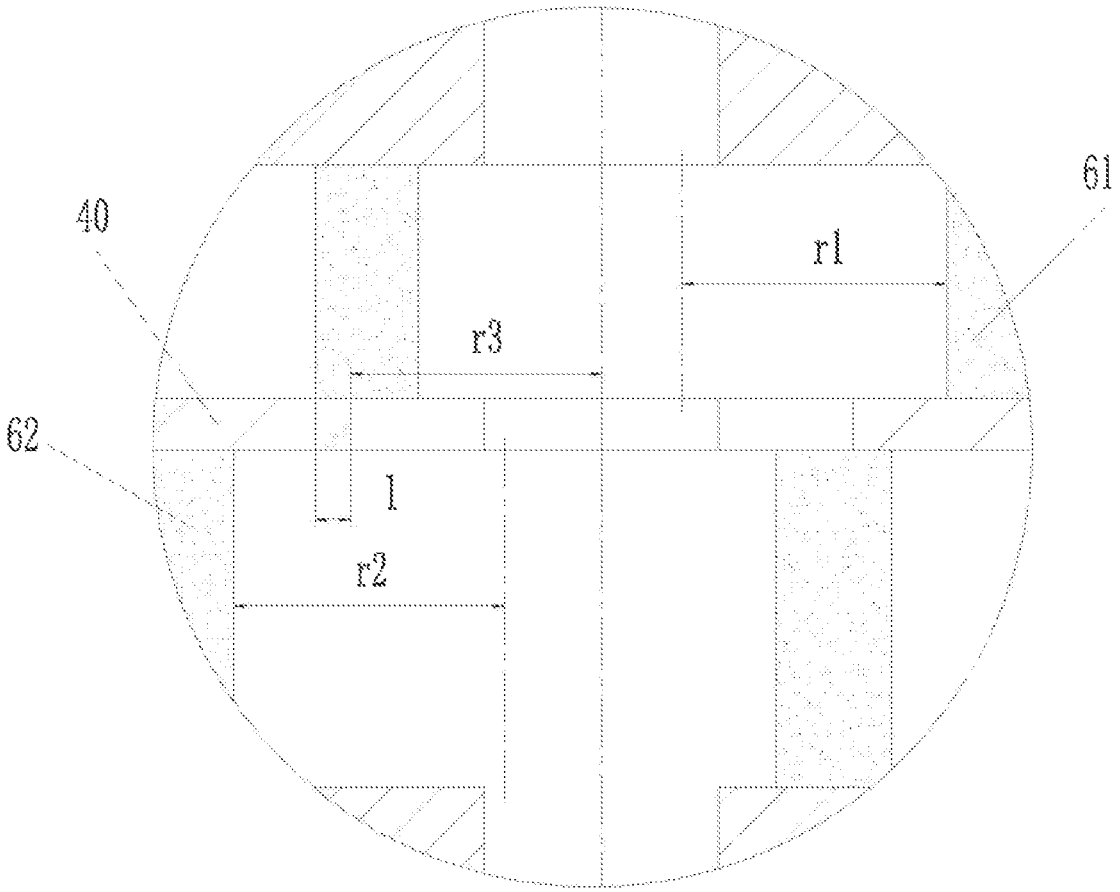
FIG. 2 is a schematic diagram illustrating an enlarged structure at a location A of a compressor in FIG. 1.

Setting of structure dimensions of the pump body: as shown in FIG. 2, as for a rolling rotor compressor, a flat design, in which a ratio of the cylinder height to the cylinder inner diameter is smaller, is more advantageous for improving the compressor performance. But for the compressor with such a structure, when the range of the volume ratio is 0.3<V1/V2<0.7, if the inner diameter R1 of the invariable-volume compression cylinder is equal to or even larger than the inner diameter R2 of the variable-volume compression cylinder, then the ratio H1/R1 of the cylinder height to the cylinder inner diameter of the invariable-volume compression cylinder is too small, which will cause the cylinder strength to be reduced, cause the cross section of the suction port to be limited, and cause the structural strength of the invariable-volume compression cylinder to be reduced, thereby not only being unfavorable for improving the performance of the compressor, but also reducing the reliability of the compressor. Therefore, relatively reasonable dimension relationships are that: R1<R2, and H1<H2; the cylinder height and cylinder inner diameter of the invariable-volume compression cylinder are reduced; accordingly the inner diameter r1 of the first roller 61 is smaller than the inner diameter r2 of the second roller 62. In order to guarantee the sealing distance between the outer circle of the first roller 61 and the inner circle of the diaphragm, and to guarantee the sealing distance between the outer circle of the second roller 62 and the inner circle of the diaphragm, the inner diameter r3 of the diaphragm should not be too large or too small. Because too small inner diameter disables a normal assembling to be completed, the proper dimension relationship is that: r1<r3<r2.

The diaphragm can be divided into a first diaphragm 41 and a second diaphragm 42, and the second diaphragm 42 is provided with a discharge port for discharging the compressed gas in the variable-volume compression cylinder, so that the variable-volume compression cylinder has two discharge ports for simultaneously discharging the compressed gas. One of the two discharge ports is disposed in at least one of the first diaphragm 41 and the second diaphragm 42, and the other discharge port is disposed in the lower flange.

In the present embodiment, multiple first cylinder assemblies can be provided, and moreover, multiple second cylinder assemblies can be provided.

In addition to the above description, it also should be noted that "one embodiment", "another embodiment", "an embodiment" and the like in the description refer to that a specific feature, a structure or a characteristic described in combination with the embodiment is included in at least one embodiment of the general description of the present disclosure. The same expression in various locations in the specification does not necessarily refer to the same embodiment. Furthermore, when a specific feature, a structure, or a characteristic are described in combination with any embodiments, what is claimed is that other embodiments which are combined to implement such a feature, a structure, or a characteristic are also included in the scope of the present disclosure.

In the above embodiments, the descriptions of the various embodiments have different emphases, and any portions that are not detailed in a certain embodiment can be seen in the related descriptions of other embodiments.

The above descriptions are merely the preferred embodiments of the present disclosure, and are not intended to limit the present disclosure. For those skilled in the art, various modifications and changes can be made for the present disclosure. Any modifications, equivalent substitutions, improvements, etc., made within the spirits and the principles of the present disclosure are included within the scope of the present disclosure.

What is claimed is:

1. A compressor comprising:

a first cylinder;

a second cylinder comprising a sliding vane slot, an intake channel, and a variable-volume control cavity, wherein the first cylinder is positioned coaxial to the second cylinder;

a partition disposed between the first cylinder and the second cylinder, wherein:

the partition comprises a first portion having a first annular groove, and a second portion having a second annular groove, the first annular groove and the second annular groove form a receiving cavity body for storing refrigerant compressed by the second cylinder, and the variable-volume control cavity is in fluid communication with the intake channel, wherein the intake channel is configured to receive high-pressure refrigerant or low-pressure refrigerant;

a sliding vane disposed in the sliding vane slot; and a locking pin disposed adjacent to the second cylinder and located at a side of the sliding vane, wherein the locking pin has a locking position for locking the sliding vane and an unlocking position for releasing the sliding vane from the locking position, further wherein when the sliding vane is in the locking position, the second cylinder is in an idling state, and further wherein when the sliding vane is in the unlocking position, the second cylinder is in an operating state;

a volume ratio of a volume of the first cylinder to a volume of the second cylinder is Q:

0.3<Q<0.7, R1<R2 and H1<H2, wherein R1 is an inner diameter of the first cylinder, H1 is a height of the first cylinder, R2 is an inner diameter of the second cylinder, and H2 is a height of the second cylinder.

2. The compressor of claim 1, wherein:

the second cylinder comprises a suction channel, the intake channel is arranged independent of the suction channel, when high-pressure refrigerant is introduced into the intake passage, the locking pin is in the unlocking place, and when low-pressure refrigerant is introduced into the intake passage, the locking pin is in the locking place.

3. The compressor of claim 1, wherein:

a discharge valve is provided in the second portion of the partition, the discharge valve having a closed position and an open position;

the second cylinder is disconnected from the receiving cavity body when the discharge valve is located in the closed position; and the second cylinder is in communication with the receiving cavity body when the discharge valve is located in the open position.

4. The compressor of claim 1, wherein a volume ratio of a volume of the first cylinder to a volume of the second cylinder is Q, wherein 0.5≤Q<0.7.

5. The compressor according to claim 1, further comprising:

an upper flange connected to a top surface of the first cylinder, wherein the upper flange is in fluid communication with the first cylinder via a first discharge port;

a lower flange connected to a bottom surface of the second cylinder, wherein the lower flange is in fluid communication with the second cylinder via a third discharge port;

wherein the second portion of the partition includes a second discharge port, further wherein the second cylinder is in fluid communication with the second portion of the partition via the second discharge port.

6. The compressor of claim 5, wherein a flow area of the first discharge port is the same as a flow area of the third discharge port.

7. The compressor of claim 1, wherein: the first cylinder has a first suction channel; the second cylinder has a second suction channel; and a minimum flow area of the second suction channel is greater than a minimum flow area of the first suction channel.

8. An air conditioner comprising a compressor of claim 1.

9. The air conditioner according to claim 8, wherein when the first cylinder and the second cylinder simultaneously operate, then 10 HZ<f1<120 HZ, wherein f1 is an operating frequency of the compressor is f1;

when the second cylinder is in an idling state, then 10 HZ<f2<70 HZ, wherein f2 is the operating frequency of the compressor.

10. A method for assembling a compressor of claim 1, comprising:

mounting an upper flange on a first cylinder with a first centering screw;

sequentially mounting a lower flange, a lower cover on a second cylinder with a second centering screw;

a combining screw sequentially passing through the upper flange, the first cylinder and a partition and being screwed on the second cylinder.

11. The compressor of claim 1, wherein the compressor further comprises a first roller disposed in the first cylinder, a second roller disposed in the second cylinder, and a rotating shaft, wherein: the rotating shaft sequentially passes through the first cylinder, the partition and the second cylinder, and is connected to the first roller and the second roller; an inner diameter of the first roller is r1, an inner diameter of the second roller is r2, an inner diameter of the partition is r3, and r1<r3<r2.

12. The compressor of claim 1, wherein the compressor further comprises a first roller disposed in the first cylinder, a second roller disposed in the second cylinder, and a rotating shaft, wherein: the rotating shaft sequentially passes through the first cylinder, the partition and the second cylinder, and is connected to the first roller and the second roller; an inner diameter of the first roller is r1, an inner diameter of the second roller is r2, an inner diameter of the partition is r3, and r1=r2<r3.

* * * * *